US011300122B2

(12) United States Patent
Moon et al.

(10) Patent No.: US 11,300,122 B2
(45) Date of Patent: Apr. 12, 2022

(54) VANE ROTARY COMPRESSOR

(71) Applicant: LG ELECTRONICS INC., Seoul (KR)

(72) Inventors: Seokhwan Moon, Seoul (KR); Seungmin Kang, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 209 days.

(21) Appl. No.: 16/598,098

(22) Filed: Oct. 10, 2019

(65) Prior Publication Data

US 2020/0224656 A1 Jul. 16, 2020

(30) Foreign Application Priority Data

Jan. 11, 2019 (KR) ..... 10-2019-0004133

(51) Int. Cl.
*F03C 2/00* (2006.01)
*F03C 4/00* (2006.01)
(Continued)

(52) U.S. Cl.
CPC ..... *F04C 2/44* (2013.01); *F04C 18/3564* (2013.01); *F04C 18/3568* (2013.01); *F04C 23/008* (2013.01)

(58) Field of Classification Search
CPC ..... F04C 2/344; F04C 2/3441; F04C 15/064; F04C 18/344; F04C 18/3441;
(Continued)

(56) References Cited

U.S. PATENT DOCUMENTS 4,702,684 A * 10/1987 Takao ..... F04C 29/12 418/259
7,255,546 B1 * 8/2007 Del Rio ..... F01C 21/0809 418/259
(Continued)

FOREIGN PATENT DOCUMENTS

CN 107882728 A * 4/2018 ..... F04C 29/02
CN 105402125 6/2018
(Continued)

OTHER PUBLICATIONS

CN-107882728-A—Wan Pengkai—Rotary Blade Type Compressor and Pump Body Assembly Thereof—Apr. 6, 2018—English Machine Translation (Year: 2018).*
(Continued)

*Primary Examiner* — Theresa Trieu
(74) *Attorney, Agent, or Firm* — KED & Associates LLP

(57) ABSTRACT

A vane rotary compressor includes: a cylinder forming a compression space having an inlet port and an outlet port, a roller having an outer circumferential surface of one side thereof almost coming into contact with an inner circumferential surface of the cylinder to form a contact point, and a plurality of vanes slidably inserted into the roller to protrude toward the inner circumferential surface of the cylinder so as to divide the compression space into a plurality of compression chambers, wherein ion at least one of the outer circumferential surface of the roller and the inner circumferential surface of the cylinder is provided a surface contact portion between the outer circumferential surface of the cylinder and the inner circumferential surface of the roller is constantly maintained in a preset section including the contact point in a circumferential direction.

16 Claims, 13 Drawing Sheets

(51) Int. Cl.

| | |
|---|---|
| ***F04C 2/00*** | (2006.01) |
| ***F04C 2/44*** | (2006.01) |
| ***F04C 18/356*** | (2006.01) |
| *F04C 23/00* | (2006.01) |

(58) Field of Classification Search
CPC ..... F04C 18/3564; F04C 18/3568; F04C 23/008; F04C 29/0035; F04C 2250/30; F04C 2250/102; F01C 1/106; F01C 21/0809; F01C 21/0872; F01C 21/106
See application file for complete search history.

(56) References Cited

U.S. PATENT DOCUMENTS

2006/0073033 A1* 4/2006 Sundheim ..... F04C 29/028 418/100
2015/0064042 A1* 3/2015 Shimaguchi ..... F04C 2/344 418/259
2015/0132168 A1* 5/2015 Tsuda ..... F04C 15/06 418/15
2018/0187680 A1* 7/2018 Moon ..... F04C 18/3441
2018/0340534 A1* 11/2018 Shin ..... F04C 18/3441

FOREIGN PATENT DOCUMENTS

JP 56054986 A * 5/1981 ..... F04C 29/02
JP 08-319975 12/1996
JP 2013-213438 10/2013
KR 10-2018-0077942 7/2018

OTHER PUBLICATIONS

Korean Office Action dated Mar. 10, 2020 issued in KR Application No. 10-2019-0004133.

* cited by examiner

VANE ROTARY COMPRESSOR

CROSS-REFERENCE TO RELATED APPLICATION(S)

Pursuant to 35 U.S.C. § 119(a), this application claims the benefit of earlier filing date and right of priority to Korean Application No. 10-2019-0004133, filed in Korea on Jan. 11, 2019, the contents of which is incorporated by reference herein in its entirety.

BACKGROUND

1. Field

The present disclosure relates to a compressor, more particularly, a vane rotary compressor.

2. Background

A rotary compressor can be broadly classified into two types, including a first type in which a vane is slidably inserted into a cylinder to come in contact with a roller, and a second type in which a vane is slidably inserted into a roller to come in contact with a cylinder. The first type of rotary compressor may be referred to simply as a 'rotary compressor', and the second type may be referred to as a 'vane rotary compressor'.

In a rotary compressor with a vane that is inserted in a cylinder, the vane may be pulled out toward a roller by elastic force or back pressure to come into contact with an outer circumferential surface of the roller. On the other hand, in a vane rotary compressor having a vane that is inserted in a roller, the vane may rotate together with the roller and may be pulled out by centrifugal force and back pressure to come into contact with an inner circumferential surface of a cylinder.

A rotary compressor independently forms a quantity of compression chambers corresponding to a number of vanes per revolution of a roller, and each compression chamber may simultaneously perform suction, compression, and discharge strokes. On the other hand, a vane rotary compressor may continuously form compression chambers corresponding to a number of vanes per revolution of a roller, and each compression chamber may sequentially perform suction, compression, and discharge strokes. Accordingly, the vane rotary compressor may typically provide a higher compression ratio than the rotary compressor. Therefore, the vane rotary compressor may often be more suitable for high pressure refrigerants, such as R32, R410a, and CO2, which may have low ozone depletion potential (ODP) and global warming index (GWP).

A type of vane rotary compressor is described in Japanese Patent Application Laid-Open No. JP2013-213438A, published on Oct. 17, 2013. This vane rotary compressor discussed in this reference may be generally limited to low-pressure applications in which a suction refrigerant is filled in an inner space of a motor room and has a structure in which a plurality of vanes may be slidably inserted into a rotating roller of the vane rotary compressor.

In the vane rotary compressor described in this reference, back pressure chambers R may be formed at rear end portions of vanes, respectively, communicating with back pressure pockets. The back pressure pockets are divided into a first pocket forming a first intermediate pressure level and a second pocket forming a second intermediate pressure level that is higher than the first intermediate pressure level and close to a discharge pressure. Oil may be depressurized between a rotation shaft and a bearing, and may be introduced into the first pocket through a gap between the rotation shaft and the bearing. Furthermore, oil may be introduced into the second pocket, with almost no pressure loss, through a flow path through the bearing due to the gap between the rotation shaft and the bearing being blocked. Therefore, the first pocket may communicate with a back pressure chamber located at an upstream side, and the second pocket may communicate with a back pressure chamber located at a downstream side based on a direction toward a discharge part from a suction part.

However, in this vane rotary compressor, a rear surface of the vane may receive pressure of the first intermediate pressure or the second intermediate pressure. On the other hand, a front surface of the vane may receive different pressure at a preceding side (or portion) and a succeeding side of the vane with respect to a movement direction of the vane. In particular, the front surface may receive compression pressure and suction pressure continuously based on a contact point where a cylinder and a roller are positioned adjacent to each other. Since the compression pressure may be higher than the back pressure, and the suction pressure may be lower than the back pressure, vane vibration may be caused by a difference of pressure applied to the front surface of the vane when the vane passes the contact point between the cylinder and the roller. At this time, the cylinder and the roller may be almost in line contact at the contact point in an axial direction such that a sealing area is narrowed, and the front surface of the vane and an inner circumferential surface of the cylinder may be separated from each other while the vane is moving backwards in a vibrating state. Then a suction chamber (e.g., a preceding compression chamber) formed by the preceding side of the vane may communicate with a discharge chamber (e.g., a succeeding compression chamber) formed by the succeeding side of the vane through a vane slot. In this situation, some of a refrigerant in the discharge chamber may flow into the suction chamber, thereby causing suction loss and compression loss.

This suction loss and compression loss may be particularly problematic when a high-pressure refrigerant, such as R32, R410a, or CO2, is used. For example, when the high-pressure refrigerant is used, a similar level of cooling capability may be obtained as that obtain when using relatively a low-pressure refrigerant such as R134a, even though a volume of each compression chamber is reduced, by increasing the number of vanes. However, as the number of vanes increases, a frictional area between the vanes and the cylinder may also be increased accordingly. As a result, a bearing surface on the rotation shaft is reduced, which makes behavior of the rotation shaft more unstable, leading to a further increase in mechanical friction loss. This undesired result may be even worse under a low-temperature heating condition, a high-pressure ratio condition (e.g., discharge pressure (Pd)/suction pressure (Ps) ≥6), or a high-speed operating condition (e.g., above 80 Hz).

The above reference is incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of a vane rotary compressor according to exemplary embodiments disclosed herein, with reference to the accompanying drawings.

Figure 1:
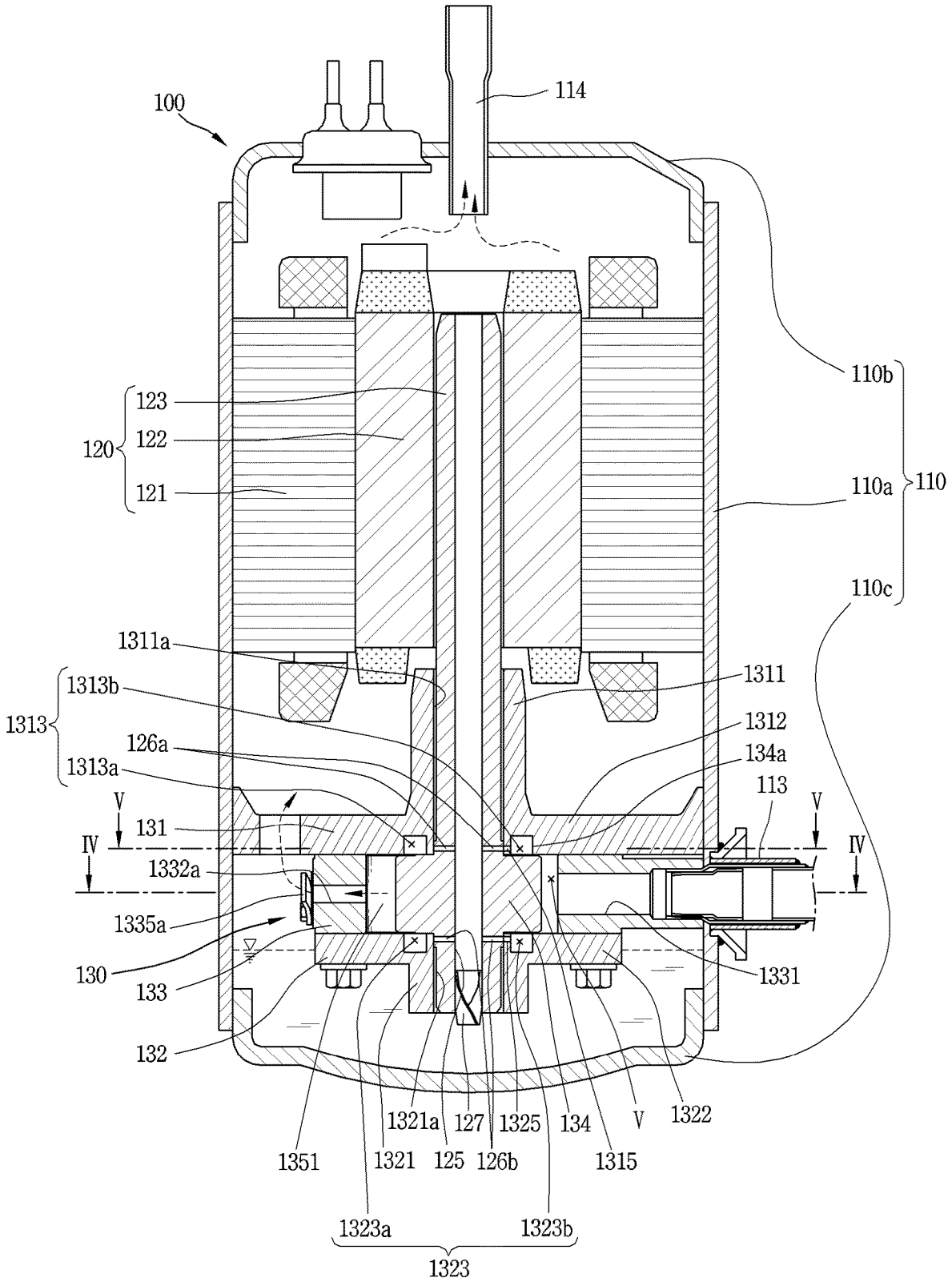
FIG. 1 is a longitudinal sectional view of an exemplary vane rotary compressor according to an implementation of the present disclosure.

FIGS. 1-4 show an example of a vane rotary compressor 100 according to the present disclosure. Referring to FIG. 1, the vane rotary compressor 100 may include a driving motor 120 installed in a casing 110, a compression unit 130 provided at one side of the driving motor 120, and a rotation shaft 123 that mechanically connects the driving motor 120 and compression unit 130 to each other.

The casing 110 may be broadly classified as a vertical type or a horizontal type according to a compressor installation method. In the vertical-type casing 110, the driving motor 120 and the compression unit 130 may be positioned at upper and lower sides along an axial direction (e.g., along the extension direction of the rotation shaft 123). With the horizontal-type casing 110, the driving motor and the compression unit may be positioned at left and right sides in an axial direction. Casing 110 may include an intermediate shell 110*a*, an upper shell 110*b*, and a lower shell 110*c*.

The driving motor 120 may provide power for compressing a refrigerant by driving a rotation of the rotation shaft 123. The driving motor 120 may include a stator 121, a rotor 122, and a rotation shaft 123. The stator 121 may be fixedly inserted into the casing 110. The stator 121 may be mounted on an inner circumferential surface of the cylindrical casing 110 in a shrink-fitting manner or using another mounting method such as using an adhesive or a coupling mechanism such as a screw. For example, the stator 121 may be fixedly mounted on an inner circumferential surface of the intermediate shell 110*a* of the casing 110.

The rotor 122 may be positioned to be spaced apart from the stator 121 and may be located at an inner portion of the stator 121. The rotation shaft 123 may be press-fitted into or otherwise mounted at a central part of the rotor 122. Accordingly, the rotation shaft 123 may rotate concentrically together with the rotor 122.

An oil flow path 125 may be formed in a central part of the rotation shaft 123 in an axial direction, and oil passage holes 126*a* and 126*b* may be formed through a middle or other interior part of the oil flow path 125 and toward an outer circumferential surface of the rotation shaft 123. The oil passage holes 126*a* and 126*b* may include a first oil passage hole 126*a* corresponding to a range of a first shaft receiving portion 1311 to be described later and a second oil passage hole 126*b* corresponding to a range of a second shaft receiving portion 1321. Each of the first oil passage hole 126*a* and the second oil passage hole 126*b* may be provided singularly or in plurality. In the following discussion, the first and second oil passage holes 126*a*, 126*b* are described as being provided in plurality, respectively.

An oil feeder 127 may be installed at the middle or a lower end of the oil flow path 125. Accordingly, when the rotation shaft 123 rotates, oil may be filled in a lower part of the casing is pumped by the oil feeder 127 and may be sucked along the oil flow path 125, so as to be introduced into a sub bearing surface 1321*a* with the second shaft receiving portion through the second oil passage hole 126*b* and into a main bearing surface 1311*a* with the second shaft receiving portion through the first oil passage hole 126*a*.

The first oil passage hole 126*a* and the second oil passage hole 126*b* may be formed so as to overlap a first oil groove 1311*b* and a second oil groove 1321*b*, respectively, which are to be explained later. In this way, oil supplied to the bearing surfaces 1311*a* and 1321*a* of a main bearing 131 and a sub bearing 132 through the first oil passage hole 126*a* and the second oil passage hole 126*b* can be quickly introduced into a main-side second pocket 1313*b* and a sub-side second pocket 1323*b* to be explained later. This configuration will be described in greater specificity below.

The compression unit 130 may include a cylinder 133 having an interior cavity in which a compression space V is formed by the main bearing 131 and the sub bearing 132 installed on respective sides of the cylinder 133 an axial direction. For example, referring to FIGS. 1 and 2, the main bearing 131 and the sub bearing 132 may be fixedly installed on the casing 110 and may be spaced apart from each other along the rotation shaft 123. The main bearing 131 and the sub bearing 132 may radially support the rotation shaft 123 and may axially support the cylinder 133 and a roller 134 at the same time. As a result, the main bearing 131 and the sub bearing 132 may include, respectively, a shaft receiving portion (or shaft receiving wall) 1311, 1321 radially supporting the rotation shaft 123, and a flange portion (or flange wall) 1312, 1322 radially extending from the shaft receiving portion 1311, 1321. For convenience of explanation, the shaft receiving portion and the flange portion of the main bearing 131 are referred to herein as the first shaft receiving portion 1311 and the first flange portion 1312, respectively, and the shaft receiving portion and the flange portion of the sub bearing 132 are referred to herein as the second shaft receiving portion 1321 and the second flange portion 1322, receptively.

Figure 3:
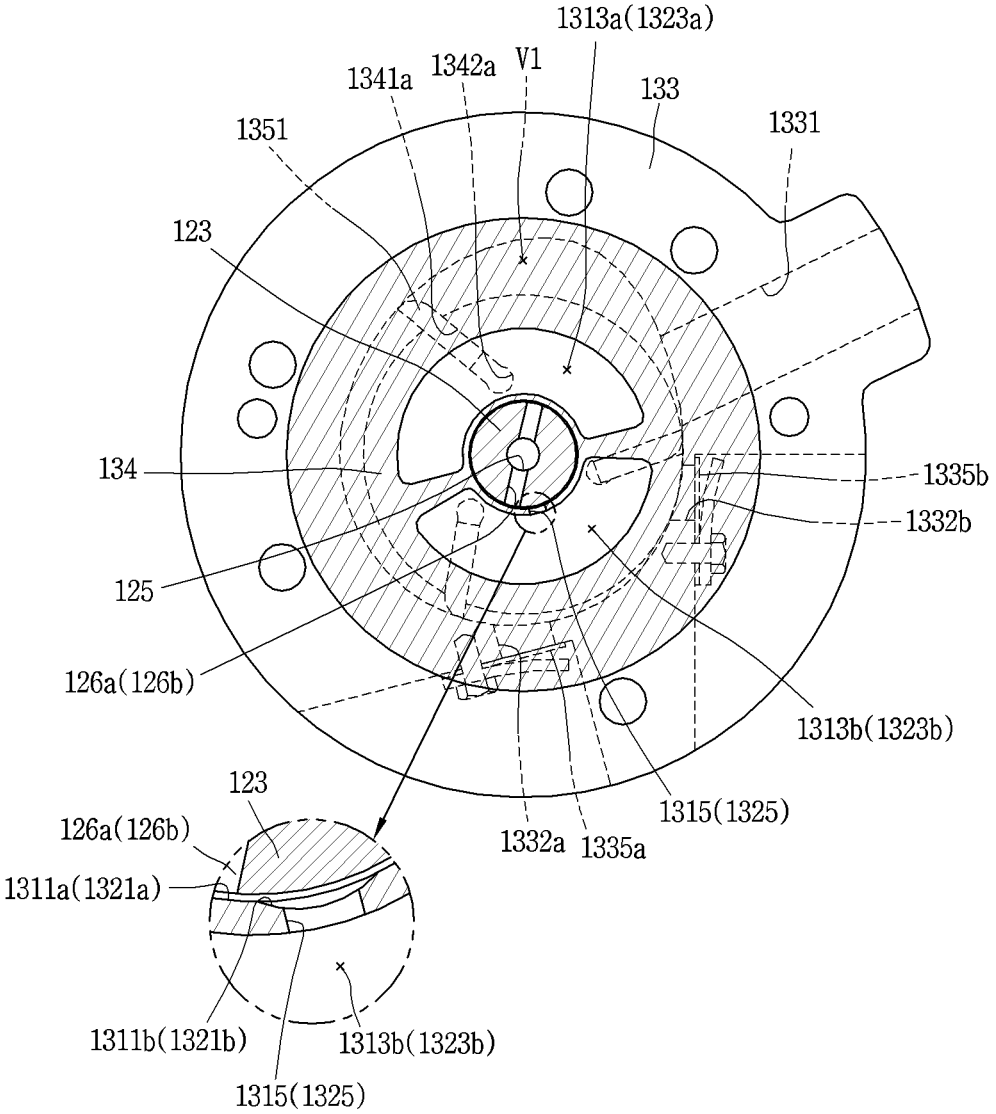
FIG. 3 is a sectional view of a compression unit in a vane rotary compressor taken along line "V-V" of FIG. 1.

Referring to FIGS. 1 and 3, the first shaft receiving portion 1311 and the second shaft receiving portion 1321 may be formed in a bush shape, receptively, and the first flange portion and the second flange portion may be formed in a disk shape, respectively. A first oil groove 1311*b* may be formed on a radial bearing surface (hereinafter, abbreviated as "bearing surface" or "first bearing surface") 1311*a*, which is an inner circumferential surface of the first shaft receiving portion 1311, and a second oil groove 1321*b* is formed on a radial bearing surface (hereinafter, abbreviated as "bearing surface" or "second bearing surface") 1321*a*, which is an inner circumferential surface of the second shaft receiving portion 1321. The first oil groove 1311*b* may be formed linearly or diagonally between upper and lower ends of the first shaft receiving portion 1311, and the second oil groove 1321*b* is formed linearly or diagonally between upper and lower ends of the second shaft receiving portion 1321.

A first communication flow path 1315 may be formed in the first oil groove 1311*b*, and a second communication flow path 1325 may be formed in the second oil groove 1321*b*. The first communication flow path 1315 and the second communication flow path 1325 are provided to guide oil flowing into the respective bearing surfaces 1311*a* and 1321*a* to a main-side back pressure pocket 1313 and a sub-side back pressure pocket 1323. This guiding of the oil flow will be explained later together those back pressure pockets 1313, 1323.

The first flange portion 1312 may include the main-side back pressure pocket 1313, and the second flange portion 1322 may include the sub-side back pressure pocket 1323. The main-side back pressure pocket 1313 may include a main-side first pocket 1313*a* and a main-side second pocket 1313*b*, and the sub-side back pressure pocket 1323 may include a sub-side first pocket 1323*a* and a sub-side second pocket 1323*b*. The main-side first pocket 1313*a* and the main-side second pocket 1313*b* may be formed with a predetermined spacing therebetween along a circumferential direction, and the sub-side first pocket 1323*a* and the sub-side second pocket 1323*b* may be formed with a predetermined spacing therebetween along a circumferential direction.

The main-side first pocket 1313*a* may form a pressure lower than pressure formed in the main-side second pocket 1313*b*, such as forming an intermediate pressure between a suction pressure (Ps) and discharge pressure (Pd). The sub-side first pocket 1323*a* may form a pressure lower than the pressure formed in the sub-side second pocket 1323*b*, such as an intermediate pressure that corresponds as the pressure of the main-side first pocket 1313*a*. The main-side first pocket 1313*a* may form an intermediate pressure by being decompressed while oil is introduced into the main-side first pocket 1313*a* through a fine or narrow passage between a main-side first bearing protrusion portion 1314*a* and an upper surface 134*a* of the roller 134, to be described later, and the sub-side first pocket 1323*a* may also form an intermediate pressure by being decompressed while oil is introduced into the sub-side first pocket 1323*a* through a fine passage between a sub-side first bearing protrusion portion 1324*a* and a lower surface 134*b* of the roller 134 to be described later. On the other hand, the main-side second pocket 1313*b* and the sub-side second pocket 1323*b* may maintain the discharge pressure or a pressure almost equal to the discharge pressure as oil, which is introduced into the main bearing surface 1311*a* and the sub bearing surface 1321*a* through the first oil passage hole 126*a* and the second oil passage hole 126*b*, flows into the main-side second pocket 1313*b* and the sub-side second pocket 1323*b* through the first communication flow path 1315 and the second communication flow path 1325 to be described later. This will be described in detail later.

An inner circumferential surface, which constitutes a compression space V of a cylinder 133, may be formed in an elliptical shape. The inner circumferential surface of the cylinder 133 may be formed in a symmetric elliptical shape having a pair of major and minor axes. The inner circumferential surface of the cylinder 133 in other implementations may have an asymmetric elliptical shape having multiple pairs of major and minor axes. The cylinder 133 formed in the asymmetric elliptical shape may be generally referred to as a hybrid cylinder, and in the following discussion, a vane rotary compressor having a hybrid cylinder is described. However, a back pressure pocket structure according to the present disclosure is equally applicable to a vane rotary compressor with a cylinder 133 having a symmetric elliptical shape.

Figure 2:
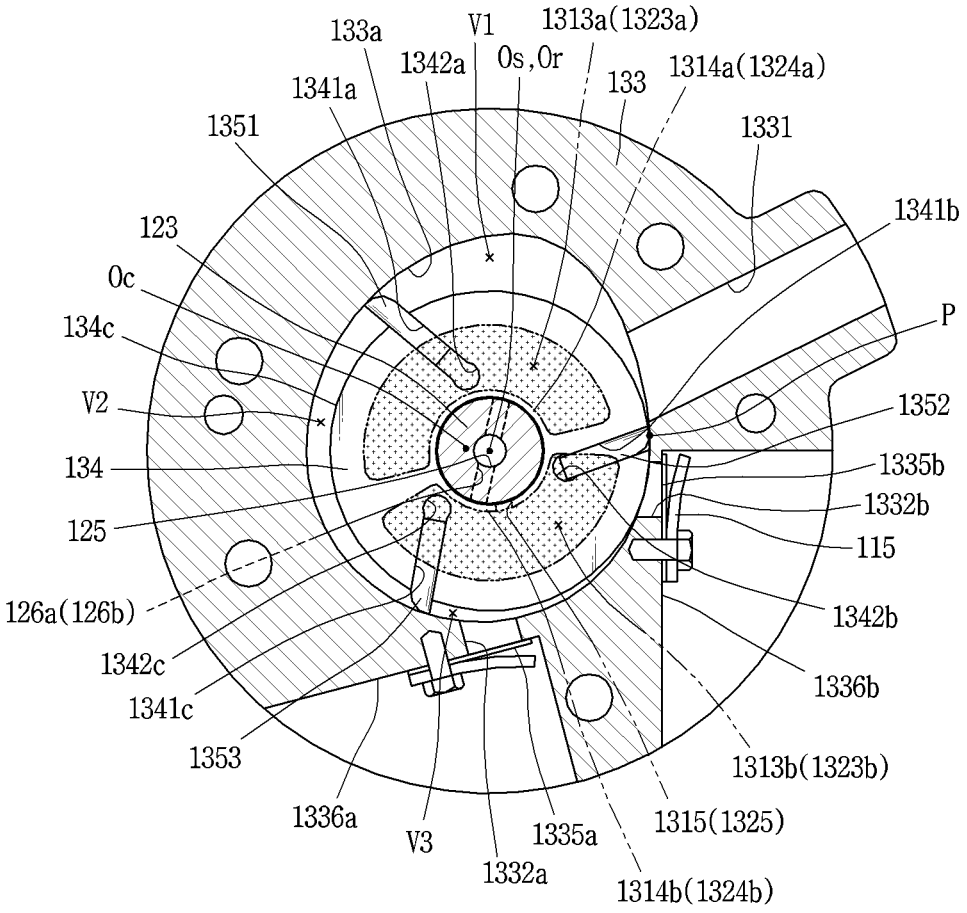
FIG. 2 is a sectional view of a compression unit in a vane rotary compressor taken along line "IV-IV" of FIG. 1.

As illustrated in FIGS. 2 and 3, an outer circumferential surface of the hybrid cylinder (hereinafter, abbreviated simply as "cylinder") 133 according to this embodiment may be formed in a circular shape. However, cylinder 133 may have an outer surface with a non-circular shape or profile, such as to provide an attachment surface to be fixed to an inner circumferential surface of the casing 110. In another example, the main bearing 131 and the sub bearing 132 may be fixed to the inner circumferential surface of the casing 110, and the cylinder 133 may be coupled to the main bearing 131 or the sub bearing 132 fixed to the casing 110 with a bolt.

In addition, an empty space may be formed in a central portion of the cylinder 133 so as to form a compression space V including an inner circumferential surface. This empty space may be sealed by the main bearing 131 and the sub bearing 132 to form the compression space Vi. The roller 134 may be rotatably coupled to the compression space Vi.

The inner circumferential surface 133*a* of the cylinder 133 may include an inlet port 1331 and outlet ports 1332*a* and 1332*b* on opposite sides in a circumferential direction with respect to a point where the inner circumferential surface 133*a* of the cylinder 133 and an outer circumferential surface 134*c* of the roller 134 are almost in contact with each other (e.g., positioned less than a threshold distance apart).

The inlet port 1331 may be directly connected to a suction pipe 113 penetrating through the casing 110, and the outlet ports 1332*a* and 1332*b* may communicate with an inner space of the casing 110, thereby being indirectly connected to a discharge pipe 114 coupled to the casing 110 in a penetrating manner. Accordingly, a refrigerant may be suctioned directly into the compression space V through the inlet port 1331 while a compressed refrigerant is discharged into the inner space of the casing 110 through the outlet ports 1332*a* and 1332*b* and then discharged to the discharge pipe 114. As a result, the inner space of the casing 110 may be maintained in a high-pressure state forming discharge pressure.

In addition, the inlet port 1331 may not include a separate inlet valve. For example, the outlet ports 1332*a* and 1332*b* may include discharge valves 1335*a* and 1335*b*, respectively, for opening and closing the outlet ports 1332*a* and 1332*b*. The discharge valves 1335*a* and 1335*b* may be a lead-type valve having one end fixed and another end free. However, various other types of valves that differ from a lead-type valve, such as a piston valve, may be used for the discharge valves 1335*a* and 1335*b* as desired.

When the lead-type valve is used for discharge valves 1335*a* and 1335*b*, valve grooves 1336*a* and 1336*b* may be formed on an outer circumferential surface of the cylinder 133 so as to mount the discharge valves 1335*a* and 1335*b*. Accordingly, the length of the outlet ports 1332*a* and 1332*b* may be reduced to a minimum, thereby decreasing in dead volume. The valve grooves 1336*a* and 1336*b* may be formed in a triangular shape so as to secure a flat valve seat surface as illustrated in FIGS. 2 and 3.

Meanwhile, for the plurality of outlet ports 1332*a* and 1332*b* may be formed along a compression passage (e.g., along a compression proceeding direction). For convenience of explanation, an outlet port located at an upstream side of the compression passage may be referred to herein as a sub outlet port (or a first outlet port) 1332*a*, and an outlet port located at a downstream side of the compression passage may be referred to as a main outlet port (or a second outlet port) 1332*b*. However, the sub outlet port 1332*a* is not necessarily required and may be selectively repositioned or adapted, as desired. For example, the sub outlet port may not be formed on the inner circumferential surface 133*a* of the cylinder 133 if overcompression of a refrigerant is appropriately reduced by forming a long compression period. In another example, the sub outlet port 1332*a* may be formed at a front part of the main outlet port 1332*b*, that is, at an upstream part of the main outlet port 1332*b* based on the compression proceeding direction in order to minimize an amount of refrigerant overcompressed.

Referring to FIGS. 2 and 3, the roller 134 may be positioned in the compression space V of the cylinder 133 in a rotatable manner. The outer circumferential surface 134*c* of the roller 134 may be formed in a circular shape, and the rotation shaft 123 may be integrally coupled to a central part of the roller 134. For example, the roller 134 may have a center Or coinciding with an axial center Os of the rotation shaft 123, and the roller 134 may concentrically rotate together with the rotation shaft 123 centering around the center Or of the roller 134.

The center Or of the roller 134 may be eccentric with respect to a center Oc of the cylinder 133 (that is, a center of the inner space of the cylinder 133) and is hereinafter, referred to as "the center of the cylinder". One side of the outer circumferential surface 134*c* of the roller 134 may be positioned to be "almost" in contact with the inner circumferential surface 133*a* of the cylinder 133, e.g., such that a distance between the outer circumferential surface 134*c* and the inner circumferential surface 133*a* is less than a threshold distance. In this configuration, an arbitrary point of the cylinder 133, where one side of the outer circumferential surface of the roller 134 is closest to the inner circumferential surface of the cylinder 133 and the roller 134 almost comes into contact with the cylinder 133, may be referred to as a contact point P, and a central line passing through the contact point P and the center of the cylinder 133 may be a position for a minor axis of the elliptical curve forming the inner circumferential surface 133*a* of the cylinder 133.

The roller 134 has a plurality of vane slots 1341*a*, 1341*b* and 1341*c* formed in an outer circumferential surface thereof at appropriate places along a circumferential direction. Vanes 1351, 1352 and 1353 are slidably inserted into the vane slots 1341*a*, 1341*b* and 1341*c*, respectively. The vane slots 1341*a*, 1341*b*, and 1341*c* may be formed in a radial direction with respect to the center of the roller 134. To secure a length of the vane, the vane slots 1341*a*, 1341*b*, and 1341*c* may be formed to be inclined at a predetermined inclination angle with respect to the radial direction to the center of the roller 134.

A direction to which the vanes 1351, 1352 and 1353 are tilted may be an opposite direction to a rotation direction of the roller 134. For example, the front surface of the vanes 1351, 1352, and 1353 in contact with the inner circumferential surface 133*a* of the cylinder 133 may be tilted in the rotation direction of the roller 134. This configuration enables a compression start angle to be moved forward in the rotation direction of the roller 134 so that compression can start quickly.

In addition, back pressure chambers 1342*a*, 1342*b*, and 1342*c* may be formed at inner ends of the vanes 1351, 1352, and 1353, respectively, to introduce oil (or refrigerant) into a rear side of the vane slots 1341*a*, 1341*b*, and 1341*c* so as to push each vane toward the inner circumferential surface of the cylinder 133. For convenience of explanation, a direction toward the cylinder with respect to a movement direction of the vane may be referred to, herein, as a "forward" direction, and an opposite direction is defined as a "backward" direction.

The back pressure chambers 1342*a*, 1342*b*, and 1342*c* may be hermetically sealed by the main bearing 131 and the sub bearing 132. The back pressure chambers 1342*a*, 1342*b*, and 1342*c* may independently communicate with the back pressure pockets 1313 and 1323, or the plurality of back pressure chambers 1342*a*, 1342*b*, and 1342*c* may be formed to communicate together through the back pressure pockets 1313 and 1323.

The back pressure pockets 1313 and 1323 may be formed in the main bearing 131 and the sub bearing 132, respectively, as shown in FIG. 1. In some cases, however, they may be formed in only one bearing of the main bearing 131 and the sub bearing 132. In this embodiment of the present disclosure, the back pressure pockets 1313 and 1323 are formed in both the main bearing 131 and the sub bearing 132. For convenience of explanation, the back pressure pocket formed in the main bearing may be referred to as a main-side back pressure pocket 1313, and the back pressure pocket formed in the sub bearing 132 may be referred to as a sub-side back pressure pocket 1323.

As described above, the main-side back pressure pocket 1313 may include the main-side first pocket 1313*a* and the main-side second pocket 1313*b*, and the sub-side back pressure pocket 1323 may include the sub-side first pocket 1323*a* and the sub-side second pocket 1323*b*. Also, the second pockets of both the main side and the sub side may form higher pressure compared to the first pockets. Accordingly, the main-side first pocket 1313*a* and the sub-side first pocket 1323*a* may communicate with a back pressure chamber to which a vane, located relatively at an upstream side (from the suction stroke to the discharge stroke) of the vanes, belongs, and the main-side second pocket 1313*b* and the sub-side second pocket 1323*b* may communicate with a back pressure chamber to which another vane, located relatively at a downstream side (from the discharge stroke to the suction stroke) of the vanes, belongs.

The vanes 1351, 1352, and 1353 may be defined referred to a "first" vane 1351, a "second" vane 1352, and a "third" vane 1353 starting from the contact point P in the compression proceeding direction, and an interval corresponding to the circumferential angle may be formed between the first vane 1351 and the second vane 1352, between the second vane 1352 and the third vane 1353, and between the third vane 1353 and the first vane 1351. Accordingly, a first compression chamber V1 may be formed between the first vane 1351 and the second vane 1352, a second compression chamber V2 may be formed between the second vane 1352 and the third vane 1353, and third a compression chamber V3 may be formed between the third vane 1353 and the first vane 1351. All of the compression chambers V1, V2, and V3 may have a substantially same volume at a same crank angle.

The vanes 1351, 1352, and 1353 may be formed to have a substantially rectangular shape. Here, end surfaces of the vane in a lengthwise direction of the vane may include a first surface in contact with the inner circumferential surface 133*a* of the cylinder 133 and herein referred to as a "front" surface of the vane, and a second surface facing the back pressure chamber 1342*a*, 1342*b*, 1342*c* and referred to herein as a "rear" surface of the vane. The front surface of each of the vanes 1351, 1352 and 1353 may be curved so as to be in line contact with the inner circumferential surface 133*a* of the cylinder 133, and the rear surface of each of the vanes 1351, 1352 and 1353 may be formed substantially flat to be inserted into the back pressure chambers 1342*a*, 1342*b*, 1342*c* so as to evenly receive back pressure.

In the vane rotary compressor having the hybrid cylinder, when power is applied to the driving motor 120 so that the rotor 122 of the driving motor 120 and the rotation shaft 123 coupled to the rotor 122 rotate together, the roller 134 may rotate together with the rotation shaft 123. Then, the vanes 1351, 1352, and 1353 may be pulled out from the respective vane slots 1341*a*, 1341*b*, and 1341*c* by a centrifugal force generated due to the rotation of the roller 134 and back pressure of the back pressure chambers 1342*a*, 1342*b*, 1342*c* provided at the rear side of the vanes 1351, 1352, and 1353. Accordingly, the front surface of each of the vanes 1351, 1352, and 1353 may be brought into contact with the inner circumferential surface 133*a* of the cylinder 133.

Then, the compression space V of the cylinder 133 is divided by the plurality of vanes 1351, 1352, and 1353 into a plurality of compression chambers (a preceding compression chamber and a succeeding compression chamber including a suction chamber or a discharge chamber) V1, V2, and V3 corresponding, respectively, to the vanes 1351, 1352 and 1353. The volume of each compression chamber V1, V2 and V3 may change according to a shape of the inner circumferential surface 133*a* of the cylinder 133 and eccentricity of the roller 134 while moving in response to the rotation of the roller 134. A refrigerant filled in each of the compression chambers V1, V2, and V3 may flow along the roller 134 and the vanes 1351, 1352, and 1353 so as to be suctioned, compressed and discharged.

Figure 4:
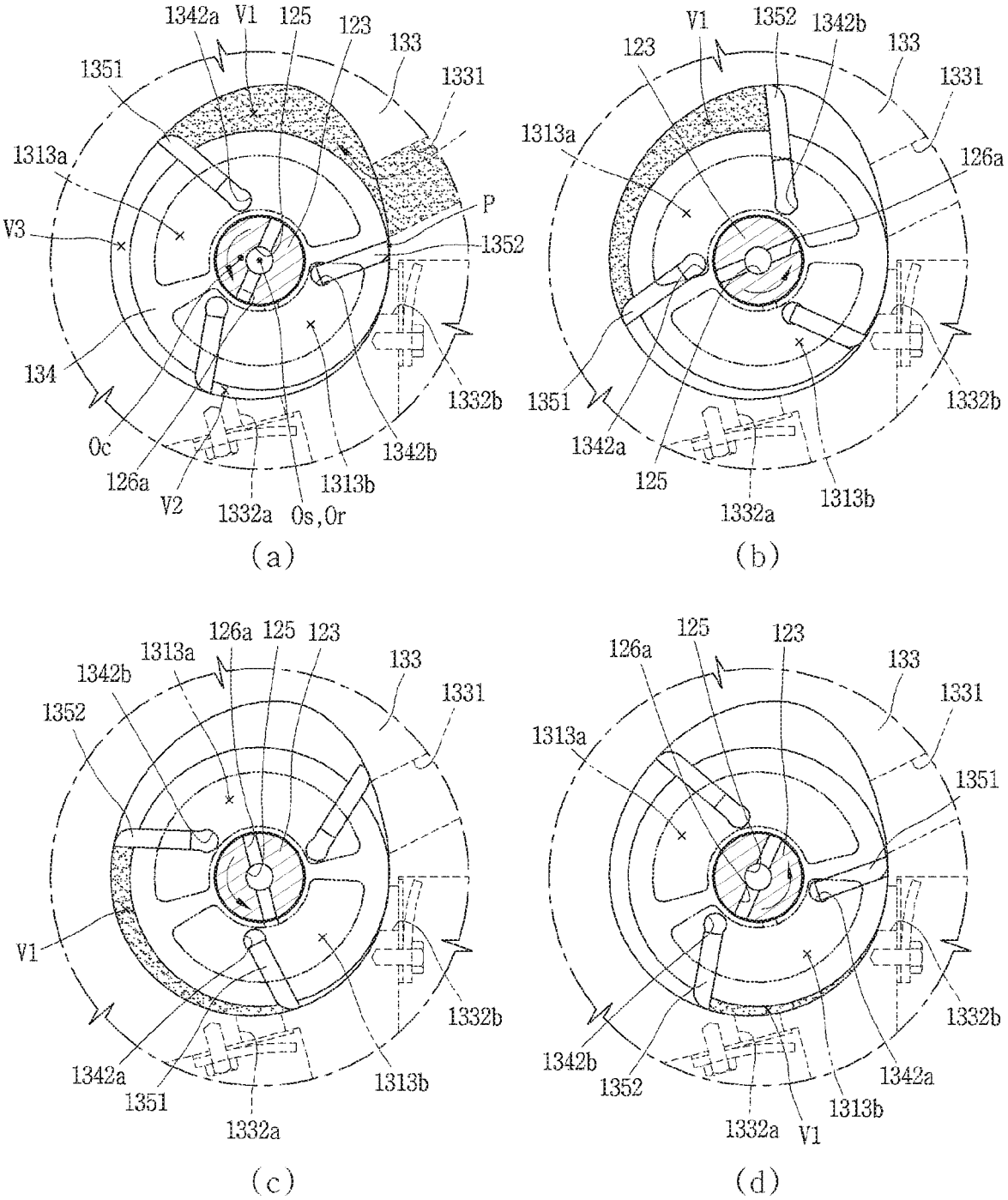
FIG. 4 provides sectional views illustrating suctioning, compressing and discharging of a refrigerant in a cylinder of a vane rotary compressor according to the present disclosure.

Sections (a) to (d) of FIG. 4 are sectional views illustrating processes of sucking, compressing, and discharging a refrigerant in a cylinder according to the embodiment of the present disclosure. In sections (a) to (d) of FIG. 4, the main bearing may be projected, and the sub bearing (not shown) may correspond to the main bearing.

As illustrated in section (a) of FIG. 4, the volume of the first compression chamber V1 may continuously increase until the first vane 1351 passes through the inlet port 1331 and the second vane 1352 reaches a suction completion time, so that a refrigerant is continuously introduced into the first compression chamber V1 from the inlet port 1331. At this time, the first back pressure chamber 1342*a* provided at the rear side of the first vane 1351 may be exposed to the first pocket 1313*a* of the main-side back pressure pocket 1313, and the second back pressure chamber 1342*b* provided at the rear side of the second vane 1352 may be exposed to the second pocket 1313*b* of the main-side back pressure pocket 1313. Accordingly, the first back pressure chamber 1342*a* may form an intermediate pressure, and the second back pressure chamber 1342*b* may form a discharge pressure or a pressure almost equal to the discharge pressure (hereinafter, referred to as "discharge pressure"). The first vane 1351 may be pressurized by the intermediate pressure, and the second vane 1352 may be pressurized by the discharge pressure, respectively, to be brought into close contact with the inner circumferential surface of the cylinder 133.

As illustrated in section (b) of FIG. 4, when the second vane 1352 performs a compression stroke after passing the suction completion time (or the compression start angle), the first compression chamber V1 may be in a sealed state and may move in a direction toward the outlet port together with the roller 134. In this motion, the volume of the first compression chamber V1 may be continuously decreased and a refrigerant in the first compression chamber V1 may be gradually compressed.

When refrigerant pressure in the first compression chamber V1 rises, the first vane 1351 may be pushed toward the first back pressure chamber 1342*a*. As a result, the first compression chamber V1 may communicate with the preceding third chamber V3, which may cause refrigerant leakage. Therefore, higher back pressure may be formed in the first back pressure chamber 1342*a* in order to prevent the refrigerant leakage.

Referring to FIG. 4, the back pressure chamber 1342*a* of the first vane 1351 is about to enter the main-side second pocket 1313*b* after passing the main-side first pocket 1313*a*. Accordingly, back pressure formed in the first back pressure chamber 1342*a* of the first vane 1351 immediately rises to discharge pressure from intermediate pressure. As the back pressure of the first back pressure chamber 1342*a* increases, it is possible to suppress the first vane 1351 from being pushed backwards.

As illustrated in section (c) of FIG. 4, when the first vane 1351 passes past the first outlet port 1332*a* and the second vane 1352 has not reached the first outlet port 1332*a*, the first compression chamber V1 may communicate with the first outlet port 1332*a*, and the first outlet port 1332*a* may be opened by pressure of the first compression chamber V1. Then, a part of a refrigerant in the first compression chamber V1 may be discharged to the inner space of the casing 110 through the first outlet port 1332*a*, so that the pressure of the first compression chamber V1 is lowered to predetermined pressure. If there is no first outlet port 1332*a*, a refrigerant in the first compression chamber V1 may further moves toward the second outlet port 1332*b*, which is the main outlet port, without being discharged from the first compression chamber V1.

At this time, the volume of the first compression chamber V1 is further decreased so that the refrigerant in the first compression chamber V1 is further compressed. However, the first back pressure chamber 1342*a* in which the first vane 1351 is accommodated may fully communicate with the main-side second pocket 1313*b* so as to form pressure almost equal to discharge pressure. Accordingly, the first vane 1351 is not pushed by back pressure of the first back pressure chamber 1342*a*, thereby suppressing a leakage between compression chambers V1, V2.

As illustrated in section (d) of FIG. 4, when the first vane 1351 passes past the second outlet port 1332*b* and the second vane 1352 reaches a discharge start angle, the second outlet port 1332*b* may be opened by refrigerant pressure in the first compression chamber V1. Then the refrigerant in the first compression chamber V1 may be discharged to the inner space of the casing 110 through the second outlet port 1332*b*.

At this time, the back pressure chamber 1342*a* of the first vane 1351 is about to enter the main-side first pocket 1313*a* as an intermediate pressure region after passing the main-side second pocket 1313*b* as a discharge pressure region. Accordingly, back pressure formed in the back pressure chamber 1342*a* of the first vane 1351 may be lowered to intermediate pressure from discharge pressure. Meanwhile, the back pressure chamber 1342*b* of the second vane 1352 is located in the main-side second pocket 1313*b*, which is the discharge pressure region, and back pressure corresponding to discharge pressure is formed in the second back pressure chamber 1342*b*.

Figure 5:
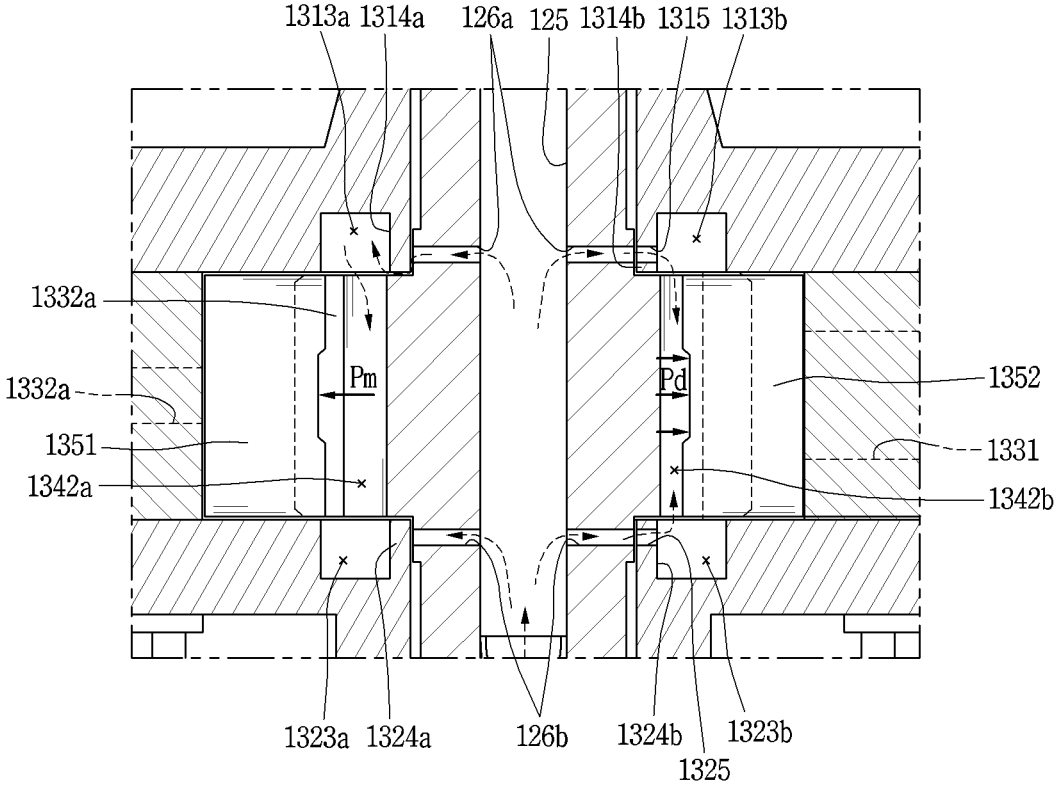
FIG. 5 is a longitudinal sectional view of a compression unit related to back pressure in a back pressure chamber in a vane rotary compressor according to the present disclosure.

FIG. 5 is a longitudinal sectional view of a compression unit for explaining back pressure of each back pressure chamber in the vane rotary compressor according to the present disclosure. Referring to FIG. 5, intermediate pressure Pm between suction pressure and discharge pressure is formed at a rear end portion of the first vane 1351 positioned in the main-side first pocket 1313*a*, and discharge pressure Pd (actually pressure slightly lower than the discharge pressure) is formed at a rear end portion of the second vane 1352 positioned in the second pocket 1313*b*. For example, as the main-side second pocket 1313*b* directly communicates with the oil flow path 125 through the first oil passage hole 126*a* and the first communication flow path 1315, pressure of the second back pressure chamber 1342*b* communicating with the main-side second pocket 1313*b* can be prevented from rising above the discharge pressure Pd. Accordingly, intermediate pressure Pm, which is much lower than the discharge pressure Pd, may be formed in the main-side first pocket 1313*a*, thereby enhancing mechanical efficiency between the cylinder 133 and the vane 135. Additionally, as a pressure equal to or slightly lower than the discharge pressure Pd may be formed in the main-side second pocket 1313*b*, the vane may be properly brought into close contact with the cylinder 133, thereby enhancing mechanical efficiency while suppressing leakage between compression chambers.

Meanwhile, the first pocket 1313*a* and the second pocket 1313*b* of the main-side back pressure pocket 1313 according to an embodiment may communicate with the oil flow path 125 via the first oil passage hole 126*a*, and the first pocket 1323*a* and the second pocket 1323*b* of the sub-side back pressure pocket 1323 may communicate with the oil flow path 125 via the second oil passage hole 126*b*.

Referring back to FIGS. 2 and 3, the main-side first pocket 1313*a* and the sub-side first pocket 1323*a* may be closed by the main-side and sub-side first bearing protrusion portions 1314*a* and 1324*a* with respect to the bearing surfaces 1311*a* and 1321*a* that the main-side and sub-side first pockets 1313*a* and 1323*a* face, respectively. Accordingly, oil (e.g., refrigerant mixed oil) in the main-side and sub-side first pockets 1313*a* and 1323*a* may flow into the bearing surfaces 1311*a* and 1321*a* through the respective oil passage holes 126*a* and 126*b*, and is decompressed while passing through a gap between the main-side and sub-side first bearing protrusion portions 1314*a* and 1324*a* and the opposite upper surface 134*a* or lower surface 134*b* of the roller 134, resulting in forming intermediate pressure.

On the other hand, the main-side and sub-side second pockets 1313*b* and 1323*b* communicate with the respective bearing surfaces 1311*a* and 1321*a*, which the second pockets face, by the main-side and sub-side second bearing protrusion portions 1314*b* and 1324*b*. Accordingly, oil (e.g., refrigerant mixed oil) in the main-side and sub-side second pockets 1313*b* and 1323*b* may flow into the bearing surfaces 1311*a* and 1321*a* through the respective oil passage holes 126*a* and 126*b* and may be introduced into the respective second pockets 1313*b* and 1323*b* via the main-side and sub-side second bearing protrusion portions 1314*b* and 1324*b*, thereby forming pressure equal to or slightly lower than the discharge pressure.

In the embodiment of the present disclosure, the main-side second pocket 1313*b* and the sub-side second pocket 1323*b* may not communicate in a fully opened state with the bearing surfaces 1311*a* and 1321*a*, which the pockets face, respectively. For example, the main-side second bearing protrusion portion 1314*b* and the sub-side second bearing protrusion portion 1324*b* may mostly block the main-side second pocket 1313*b* and the sub-side second pocket 1323*b*, and may partially block the respective second pockets 1313*b* and 1323*b* with the communication flow paths 1315 and 1325 interposed therebetween.

The flange portion 1312 of the main bearing 131 may include the main-side first pocket 1313*a* and second pocket 1313*b* formed along a circumferential direction with a predetermined distance, and the flange portion 1322 of the sub bearing 132 may include the sub-side first pocket 1323*a* and second pocket 1323*b* formed along the circumferential direction with a predetermined distance. Inner circumferential sides of the main-side first pocket 1313*a* and the second pocket 1313*b* may blocked by the main-side first bearing protrusion portion 1314*a* and the main-side second bearing protrusion portion 1314*b*, respectively. Additionally, the inner circumferential sides of the sub-side first pocket 1323*a* and second pocket 1323*b* may be blocked by the sub-side first bearing protrusion portion 1324*a* and second bearing protrusion portion 1324*b*, respectively. Accordingly, the shaft receiving portion 1311 of the main bearing 131 may form a cylindrical bearing surface 1311*a* having a substantially continuous surface, and the shaft receiving portion 1321 of the sub bearing 132 may form a cylindrical bearing surface 1321*a* having a substantially continuous surface. In addition, the main-side first bearing protrusion portion 1314*a*, the second bearing protrusion portion 1314*b*, and the sub-side first bearing protrusion portion 1324*a*, the second bearing protrusion portion 1324*b* form a kind of elastic bearing surface.

The first oil groove 1311*b* may be formed on the bearing surface 1311*a* of the main bearing 131, and the second oil groove 1321*b* may be formed on the bearing surface 1321*a* of the sub bearing 132. The main-side second bearing protrusion portion 1314*b* may include the first communication flow path 1315 for communicating the main-side bearing surface 1311*a* with the main-side second pocket 1313*b*. Furthermore, the sub-side second bearing protrusion portion 1324*b* may include the second communication flow path 1325 that enables communications between the sub-side bearing surface 1321*a* and the sub-side second pocket 1323*b*.

The first communication flow path 1315 may be formed at a position to overlap with the main-side second bearing protrusion portion 1314*b* and the first oil groove 1311*b* at the same time, and the second communication flow path 1325 may be formed at a position where it overlaps the sub-side second bearing protrusion portion 1324*b* and the second oil groove 1321*b* at the same time. Also, the first communication flow path 1315 and the second communication flow path 1325, as illustrated in FIG. 5, may be formed as a communication hole passing through inner and outer circumferential surfaces of the main-side and sub-side second bearing protrusion portions 1314*b* and 1324*b*. Although not shown in the drawings, one or more both of the first communication flow path 1315 and the second communication flow path 1325 may alternatively be formed as a communication groove recessed by a predetermined width and depth in a cross section of the main-side second bearing protrusion portion 1314*b* and the sub-side second bearing protrusion portion 1324*b*.

In the vane rotary compressor according to an embodiment of the present disclosure, a continuous bearing surface may be formed mostly at the main-side second pocket 1313*b* and the sub-side second pocket 1323*b*, and behavior of the rotation shaft 123 can be stabilized so as to enhance mechanical efficiency of the compressor. In addition, as the main-side second bearing protrusion portion 1314*b* and the sub-side second bearing protrusion portion 1324*b* may be provided substantially close the main-side second pocket 1313*b* and the sub-side second pocket 1323*b* except for the communication flow paths, the main-side second pocket 1313*b* and the sub-side second pocket 1323*b* may better maintain a constant volume. Accordingly, pressure pulsation of back pressure to support the vane in the main-side second pocket 1313*b* and the sub-side second pocket 1323*b* can be lowered to stabilize behavior of the vane while suppressing vibration. As a result, collision noise between the vane and the cylinder and leakage between compression chambers can be reduced, thereby improving compression efficiency.

Furthermore, foreign substances may be prevented from being introduced and accumulated between the bearing surfaces 1311*a*,1321*a* and the rotation shaft 123 via the main-side second pocket 1313*b* and the sub-side second pocket 1323*b* even during long-time operation. This characteristic may result in preventing abrasion of the bearings 131 and 132 or the rotation shaft 123.

In addition, according to aspects of the present disclosure, when a high-pressure refrigerant, such as R32, R410a, and CO2, is used, surface pressure against a bearing may be higher than that when a medium to low pressure refrigerant such as R134a is used. However, it is possible to increase a radial support force with respect to the rotation shaft 123 described above. Also, for a high-pressure refrigerant, a surface pressure against the vane may rise as well, which may cause leakage between compression chambers or vibration. However, a contact force between the vanes 1351, 1352, 1353 and the cylinder 133 can be appropriately maintained by maintaining back pressure of the back pressure chambers according to each vane. Also, in the vane rotary compressor according to the present disclosure, a surface contact portion may be formed between the outer circumferential surface of the roller 134 and the inner circumferential surface of the cylinder 133, such that leakage between compression chambers in the vicinity of the contact point can be suppressed, thereby enhancing reliability of the vane rotary compressor using the high-pressure refrigerant.

Further, in the vane rotary compressor according to aspects of the present disclosure, a radial support force with respect to the rotation shaft can be enhanced even under a low-temperature heating condition, a high pressure ratio condition, and/or a high-speed operation condition. In addition, leakage between the compression chambers can be substantially suppressed by securing a sealing area between the outer circumferential surface of the roller 134 and the inner circumferential surface of the cylinder 133.

Meanwhile, in the vane rotary compressor to according aspects of the present disclosure, as aforementioned, vane vibration may occur adjacent to a contact point between the cylinder and the roller, and this vane vibration may cause a striking noise, vibration, or abrasion on the cylinder or the vane. For example, when the vane passes in the vicinity of a contact point area associated with the contact point, the vane slot in which the vane is inserted also passes in the vicinity of the contact point area, and the inner circumferential surface of the cylinder and the outer circumferential surface of the roller are greatly separated from each other by the vane slot at the contact point. In this positioning, when the front surface of the vane is spaced apart from the inner circumferential surface of the cylinder, the vane slot may act as a sort of a refrigerant passage, causing a significant suction loss or compression loss.

To address this phenomenon, a surface contact portion, which is a sort of sealing section, may be formed on the inner circumferential surface of the cylinder or the outer circumferential surface of the roller so that a sufficient sealing area is secured between the cylinder and the roller even when the front surface of the vane is spaced apart from the inner circumferential surface of the cylinder adjacent to the contact point. Accordingly, it is possible to prevent a refrigerant in the discharge chamber, which is a succeeding compression chamber, from being introduced into the suction chamber, which is a preceding compression chamber in the vicinity of the contact point, thereby reducing suction loss and compression loss.

Figure 6:
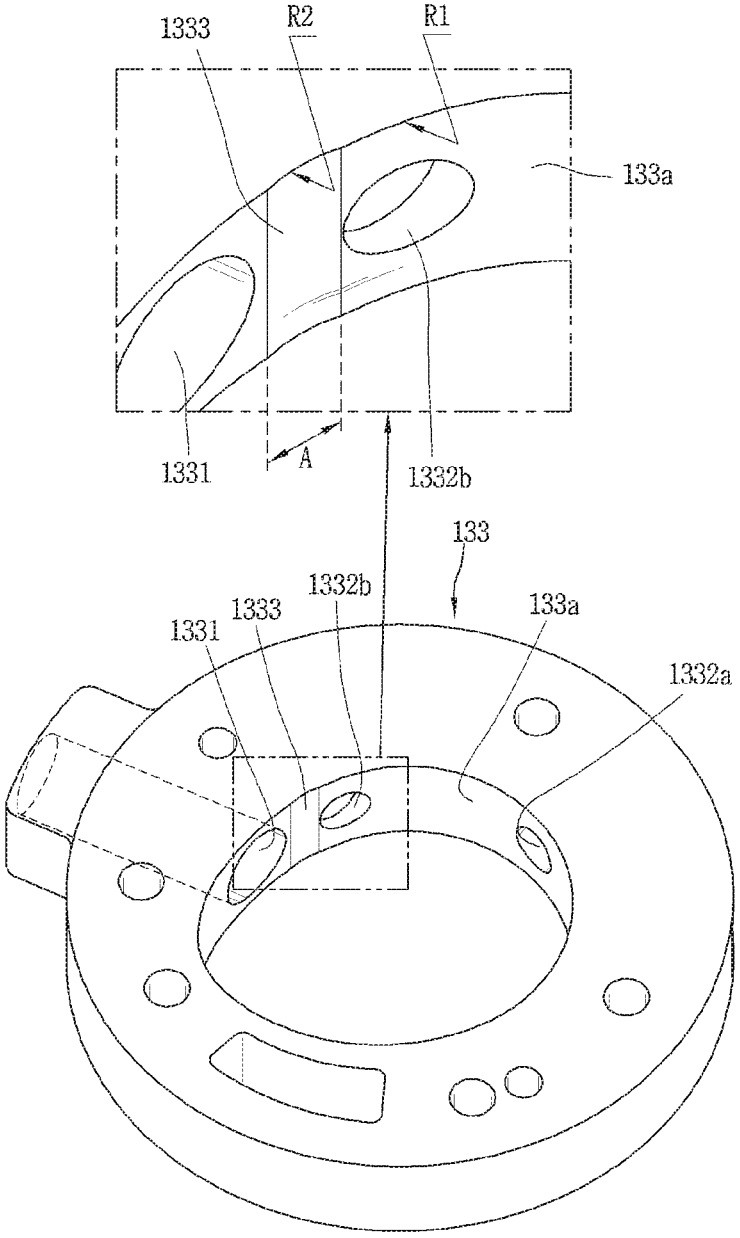
FIG. 6 is a perspective view illustrating a cylinder of a vane rotary compressor according to the present disclosure.
Figure 7:
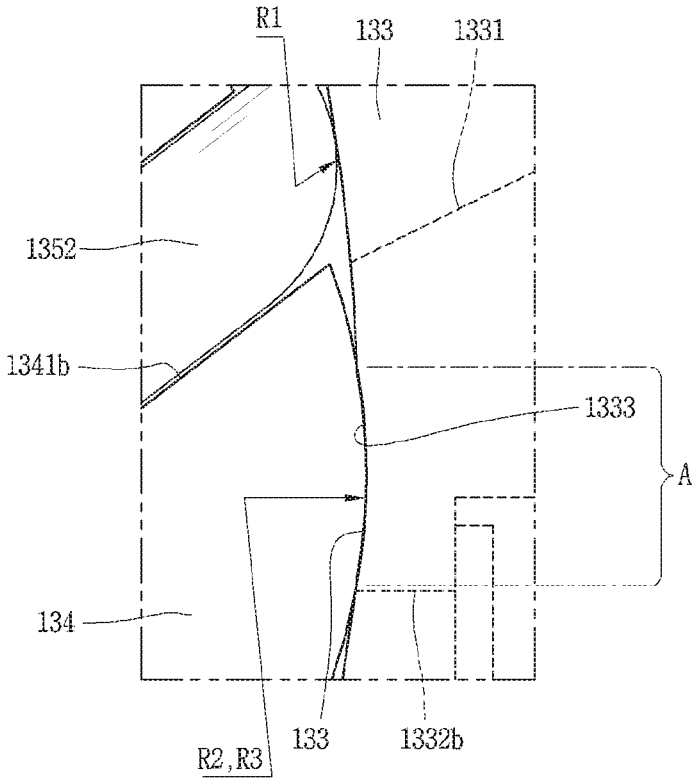
FIG. 7 is an enlarged planar view illustrating a cylinder, a roller, and a vane during a contact between the cylinder and the roller in a vane rotary compressor according to the present disclosure.

FIG. 6 is a perspective view illustrating a cylinder in a vane rotary compressor according to the present disclosure, and FIG. 7 is an enlarged planar view illustrating a contact state of a cylinder, a roller, and a vane in the vicinity of the contact point between the cylinder and the roller according to the present disclosure. Hereinafter, description will be given typically of a vane positioned in the vicinity of the contact point for the sake of convenience. However, since vanes are rotated together with the roller, other vanes have the same configuration and operation effects.

Referring back to FIGS. 2 and 3, the cylinder 133 may include the inlet port 1331 and the second outlet port 1332*b* at both sides of the contact point P, and the roller 134 may include the vane slot 1341 (e.g., the second vane slot 1341*b*) in which the vane 1352 (e.g., the second vane 1352*b*) is slidably inserted. The back pressure chamber 1342*b* may be formed at the rear end portion of the vane slot 1341*b* so as to communicate with the back pressure pockets 1313*a*, 1313*b*, and 1323*a*, 1323*b*.

The length of the vane slot 1341*b* may be shorter than that of the vane 1352. However, the back pressure chamber 1342*b* may be formed at the rear side of the vane slot 1341*b*, and a combined length of an inner diameter of the back pressure chamber 1342*b* and the length of the vane slot 1341*b* may be longer than the length of the vane 1352. Therefore, the vane 1352 can move forward and backward (e.g., in an inward and outward direction of the roller 134) inside of the vane slot 1341*b* and the back pressure chamber 1342*b*.

Accordingly, when the vane 1352 may be completely inserted into the back pressure chamber 1342*b* and the vane slot 1341*b*, the front surface of the vane 1352 may be located more inwardly than an outer circumferential end of the vane slot 1341*b*. Then, the outer circumferential surface of the roller 134 may be recessed at a portion where the vane slot 1341*b* is formed with respect to the inner circumferential surface 133*a* of the cylinder 133. Thereby the cylinder 133 and the roller 134 may be separated from each other, and a gap between the cylinder 133 and the roller 134 may become a passage for refrigerant leakage. In view of this occurrence, a surface contact portion (or surface contact region) 1333 that comes in surface contact with the outer circumferential surface of the roller may be formed in a predetermined section including the contact point P on the inner circumferential surface of the cylinder 133. Thus, the surface contact portion 1333 may provide a sealing area for blocking the refrigerant leakage passage even when the vane 1352 is fully inserted into the vane slot 1341*b*.

For example, as shown in FIGS. 6 and 7, the inner circumferential surface 133*a* of the cylinder 133 may be formed in a circular shape as a whole, or in an elliptical shape with a plurality of circles. An example of a cylinder 133 having elliptical-shaped inner circumferential surface will be described.

A preset section A including the contact point P on the inner circumferential surface 133*a* of the cylinder 133 may be formed to have a larger curvature than other sections (in particular, consecutive sections of a surface contact section) in order to form the surface contact portion 1333. For example, a curvature R2 of the surface contact portion 1333 may be larger than a curvature R1 of the inner circumferential surface of the cylinder 133 in the vicinity of the contact point, and may be equal to or almost equal to a curvature R3 of the outer circumferential surface of the roller 134.

For example, since the outer circumferential surface 134*c* of the roller 134 may be formed in a circular shape having single curvature, the inner circumferential 133*a* of the cylinder 133 may include the surface contact portion 1333 which is formed in the preset section A that includes the contact point P in a circumferential direction. Furthermore, the outer circumferential surface 134*c* of the roller 134 and the inner circumferential surface 133*a* of the cylinder 133 are in contact with each other or constantly maintain a fine gap therebetween in an almost contact state (e.g., the surfaces separated by less than a threshold distance) at the preset section A.

The surface contact portion 1333 may be formed between the second outlet port 1332*b* and the inlet port 1331. The surface contact portion 1333 may be formed in a rectangular shape that is long in an axial direction in a lateral projection. For example, since the vane 1352 forms a rectangular box shape or cuboid shape that is linear in the axial direction, the surface contact portion 1333 may be formed in a rectangular shape that is linear in the axial direction, accordingly.

In this configuration, both lateral side surfaces of the surface contact portion 1333 may be located between an end of the second outlet port 1332*b* and a start end of the inlet port 1331 facing the second outlet port 1332*b* with respect to a rotation direction of the vane 1352. In addition, an axial length of the surface contact portion 1333 may substantially corresponding to an axial length of the cylinder 133. Accordingly, the surface contact portion 1333 may be formed in a manner that both axial ends of the cylinder 133 are opened.

Figure 8:
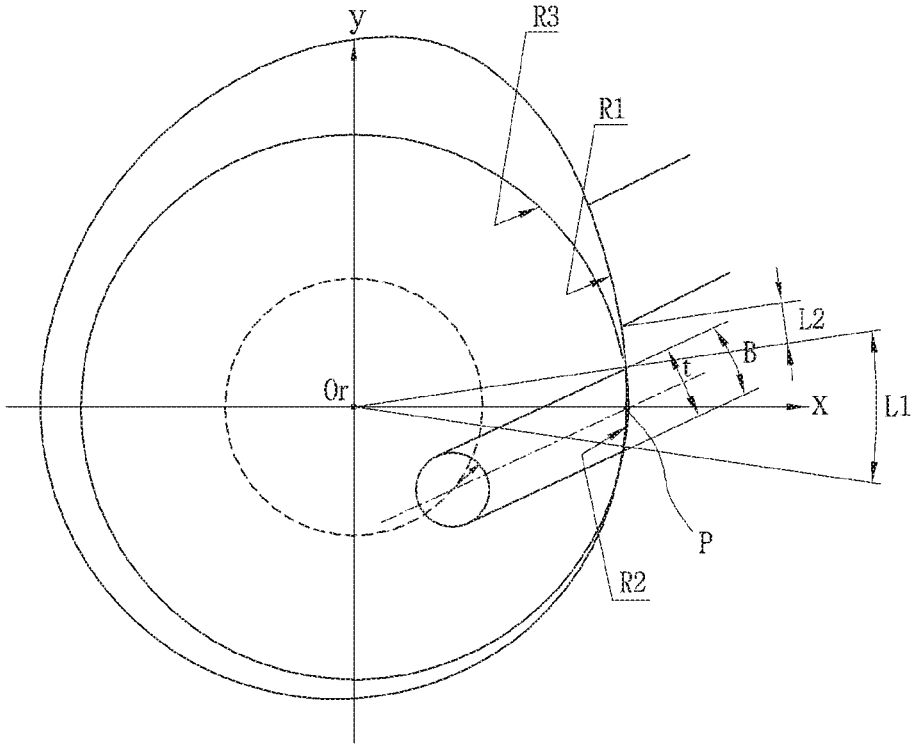
FIG. 8 is a schematic view illustrating a surface contact portion between a cylinder and a roller of a vane rotary compressor according to the present disclosure.

FIG. 8 is a schematic view illustrating a contact surface portion 1333 between a cylinder 133 and a roller 134 according to an embodiment of the present disclosure. An arc length L1 of the surface contact portion 1333 may be formed in consideration of an angle at which the vane slit 1341*b* goes (moves) over the contact point P. For instance, when the angle at which the vane slit 1341*b* moves over the contact point P is approximately 7.8°, then the arc length L1 of the surface contact portion 1333 may be approximately 0.136×d (a radius of the outer circumferential surface of the roller or a radius of the inner circumferential surface of the cylinder).

However, when the surface contact portion 1333 is located too close to the inlet port 1331, a refrigerant in the discharge chamber, which is the succeeding compression chamber, may flow back to the suction chamber, which is the preceding compression chamber, due to a pressure difference between the discharge and compression chambers. Therefore, a proper sealing length may be provided between the surface contact portion 1333 and the inlet port 1331. For instance, the shortest lateral distance L2 between the surface contact portion 1333 and the inlet port 1331 may be set to be approximately equal to a lateral width t of the vane 1352, e.g., slightly smaller or larger than or equal to the lateral width of the vane, in view of preventing refrigerant leakage through the vane slot 1341*b*. When a lateral thickness of the vane 1352 is approximately 2 to 3 mm, the lateral width t of the vane slot is slightly larger than or similar to the lateral thickness of the vane 1352 such that the lateral width t of the vane slot may also be approximately 2 to 3 mm. Thus, in this example in which a lateral thickness of the vane 1352 is approximately 2 to 3 mm, a shortest lateral distance L2 between the surface contact portion 1333 and the inlet port 1331 may be approximately 2 mm or more.

In this configuration, as the surface contact portion 1333 becomes larger in the circumferential direction, the sealing area also becomes larger, thereby more effectively suppressing refrigerant leakage. However, as the surface contact portion 1333 becomes larger, shear force loss due to oil viscosity occurs. Accordingly, motor efficiency decreases as motor input increases, thereby deteriorating compressor performance. Therefore, the surface contact portion 1333 is preferably formed as small as possible to maintain motor efficiency while still being within a size range to secure the sealing area. For example, the surface contact portion 1333 may be formed within a range B of an arc length formed by connecting both ends of the outer circumferential side of the vane slot 1341*b* from an axial center (Or) of the roller 134.

Figure 9:
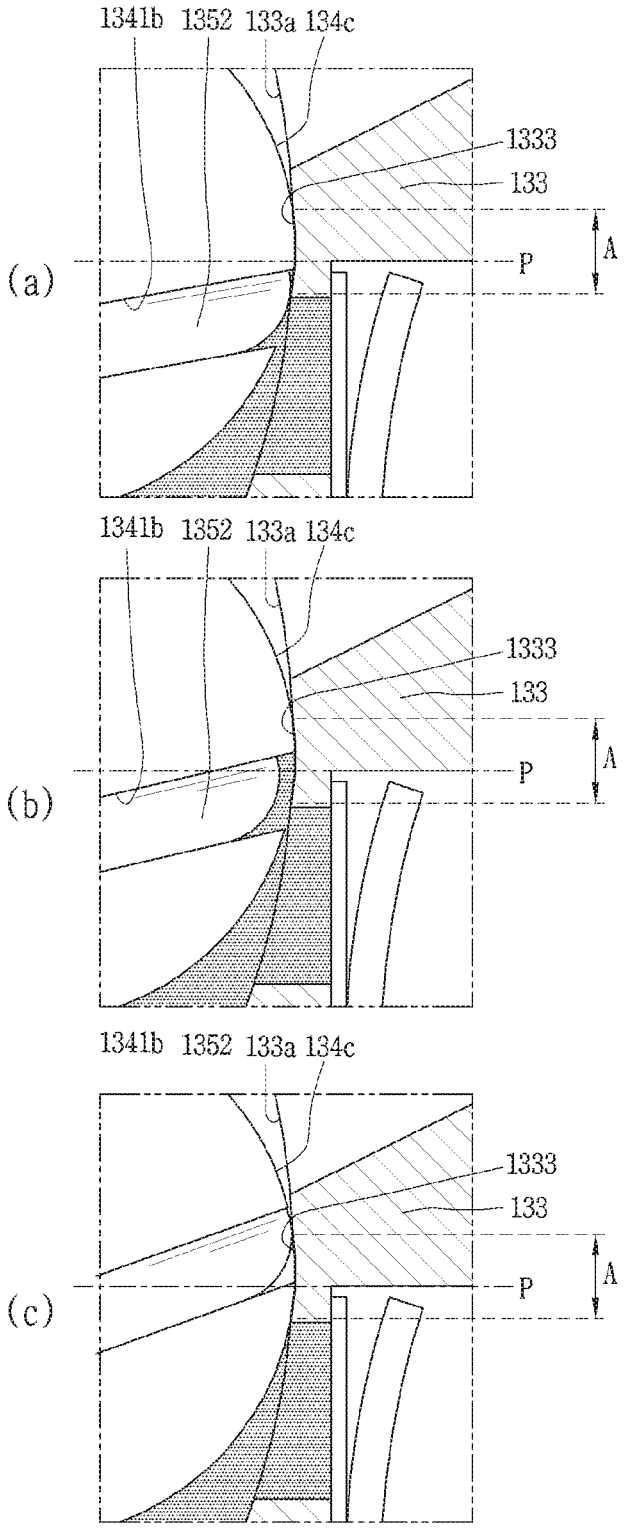
FIG. 9 provides schematic views illustrating a process of sealing a refrigerant by a surface contact portion when a vane passes a contact point in a vane rotary compressor according to the present disclosure.

FIG. 9 is a schematic view illustrating a process in which a refrigerant is sealed by a surface contact portion 1333 when a vane 1352 passes a contact point P in a vane rotary compressor according to the present embodiment. For example, in the vane rotary compressor according to the present disclosure, when the vane 1352 rotates together with the roller 134, trembling (e.g., vibration) may occur due to a pressure difference in the vicinity of the contact point P, which may cause the vane 1352 to be inserted into the vane slot 1341*b*. Then the vane slot 1341*b* may become a sort of a refrigerant leakage passage, which may allow a refrigerant in the succeeding compression chamber to flow into the suction chamber which is the preceding compression chamber.

However, when the surface contact portion 1333 is formed in the section A including the contact point P of the inner circumferential surface of the cylinder 133 according to an embodiment, the inner circumferential surface 133*a* of the cylinder 133 and the outer circumferential surface 134*c* of the roller 134 may be substantially in surface contact with each other at the surface contact portion 1333 of the cylinder 133. The surface contact the inner circumferential surface 133*a* of the cylinder 133 and the outer circumferential surface 134*c* of the roller 134 at the surface contact portion 1333 may secure the sealing area even if the refrigerant passage is formed as the vane 1352 moves into the vane slot 1341*b*. Then the succeeding compression chamber and the preceding compression chamber may be kept separated from each other so as to effectively prevent the refrigerant in the succeeding compression chamber from leaking into the preceding compression chamber. Accordingly, the refrigerant leakage from the succeeding compression chamber to the preceding compression chamber in the vicinity of the contact point P of the vane rotary compressor can be minimized, thereby reducing compression loss and suction loss.

Meanwhile, as described above, increasing the circumferential length L1 of the surface contact portion 1333 may increase the sealing area, which is advantageous for suppressing refrigerant leakage. However, as the sealing area increases, a frictional area generated by oil viscosity also increases, which may result in deteriorating overall compressor performance. Therefore, according to an embodiment of the present disclosure, a friction avoiding portion (or recess) 1334 may be further provided to secure the sealing area while suppressing an excessive increase in friction loss.

Figure 10:
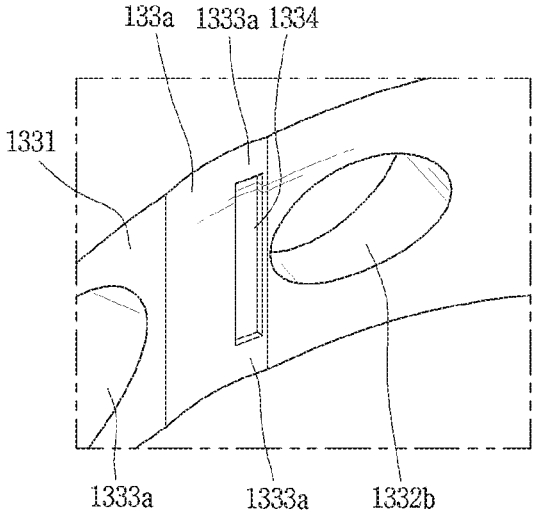
FIG. 10 is an enlarged perspective view illustrating a surface contact portion of a cylinder of a vane rotary compressor according to the present disclosure.
Figure 11:
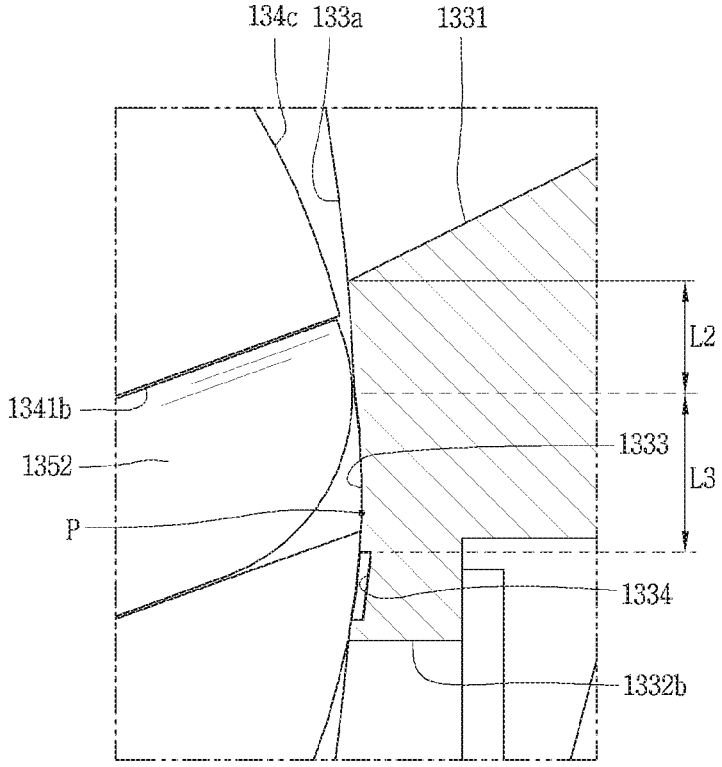
FIG. 11 an enlarged planar view illustrating a cylinder of FIG. 10, a roller, and a vane during a contact between the cylinder and the roller in a vane rotary compressor according to the present disclosure.

Referring to FIGS. 10 and 11, a friction avoiding portion 1334 may be further provided substantially near a middle of the surface contact portion 1333 according to one implementation. For example, the friction avoiding portion 1334 may be formed as a recessed dimple having a preset depth and preset width within a range of the surface contact portion 1333. For example, the friction avoiding portion 1334 may be formed in the inner circumferential surface of the cylinder 133.

The friction avoiding portion 1334 may be formed so that the lateral length L3 from the contact point P to an end of the friction avoiding portion 1334 in a rotation direction of the roller 134 is greater than or equal to the lateral thickness t of the vane. Accordingly, the friction avoiding portion 1334 may be eccentrically positioned toward the second outlet port 1332*b* based on the contact point P, and may be formed out of a range of the second outlet port 1332*b*. If the friction avoiding portion 1334 recessed in a dimple shape is formed to overlap with the second outlet port 1332*b*, the friction avoiding portion 1334 may communicate with the second outlet port 1332*b*, which may result in an increase in a dead volume of the compressor. Also, when the friction avoiding portion 1334 communicates with the second outlet port 1332*b*, the friction avoiding portion 1334 and the second outlet port 1332*b* may combines to provide a fluid pathway enabling communications between the discharge chamber, which is the succeeding compression chamber, and the suction chamber, which is the preceding compression chamber, when the vane 1352 passes through the second outlet port 1332*b*. This may cause the friction avoiding portion 1334 to act as a passage for refrigerant leakage. Accordingly, the friction avoiding portion 1334 may be formed in a position where it does not overlap with the second outlet port 1332*b* to prevent it from communicating with the second outlet port 1332*b*.

Figure 12:
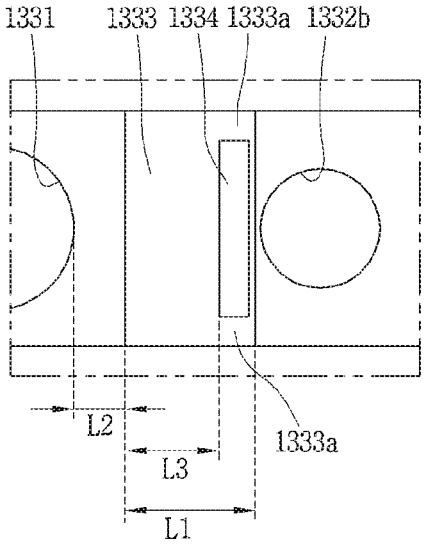
FIG. 12 is a front view illustrating a vicinity of a surface contact portion of a cylinder in a vane rotary compressor of FIG. 10.

In addition, the friction avoiding portion 1334, as shown in FIG. 12, may be formed in a rectangular shape in a lateral projection. In one example, the friction avoiding portion 1334 may be shorter than the axial length of the cylinder 133 so that sealing surfaces 1333*a* are formed at both ends of the axial direction, respectively, thereby securing the sealing area in the surface contact portion. The friction avoiding portion 1334, as described above, may be formed in a single rectangular cross-sectional shape, but may be divided into a plurality of portions in an axial direction to be formed in a depressed shape or an embossed shape.

Figure 13:
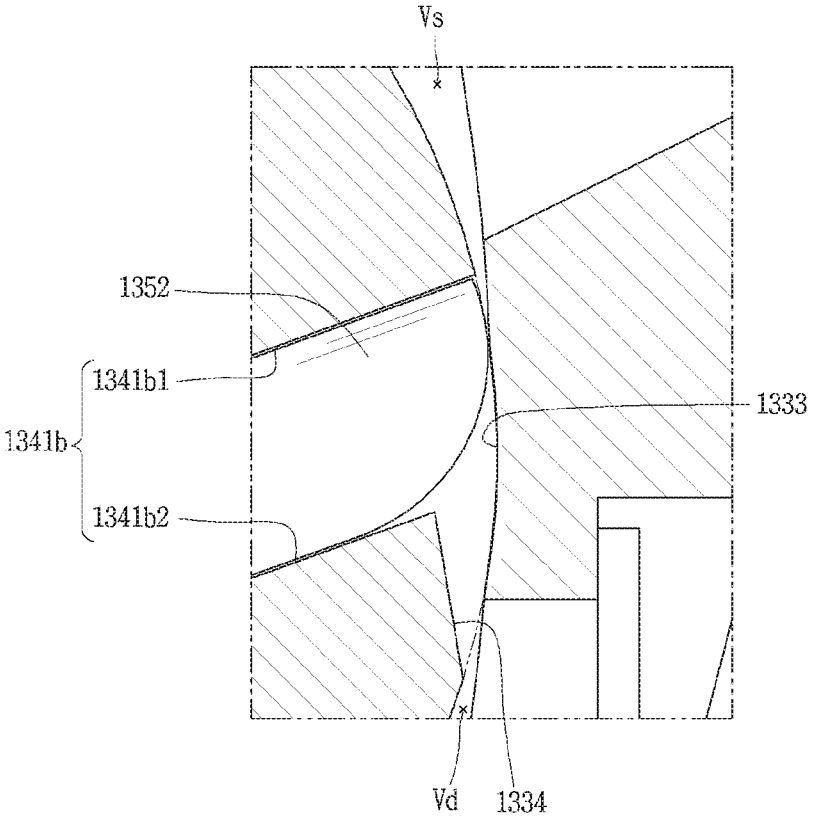
FIG. 13 is a planar view illustrating a friction avoiding portion in a vane rotary compressor according to the present disclosure.

Meanwhile, in the foregoing embodiments, the friction avoiding portion 1334 may be formed on the inner circumferential surface of the cylinder 133, such as the surface contact portion. However, the friction avoiding portion may alternatively be formed on the outer circumferential surface of the roller 134 as illustrated in an embodiment of the present disclosure. For example, FIG. 13 provides a planar view illustrating the friction avoiding portion 1334 according to the present disclosure. For reference, attributes of the friction avoiding portion 1334 are exaggerated in FIG. 13 for convenience of explanation.

As illustrated in FIG. 13, a friction avoiding portion 1344 may formed on the outer circumferential surface of the roller 134 and, more specifically, may be formed on a portion of the outer circumferential surface of the roller 134 which is connected to the vane slot 1341*b*. In this configuration, the friction avoiding portion 1344 may be formed on both sidewalls of the vane slot 1341*b* by cutting across the outer circumferential side of the vane slot 1341*b*. However, a preceding sidewall surface 1341*b*1 of the vane slot 1341*b* is a surface corresponding to a suction side surface of the vane 1352, and it may be preferable to maintain an area as large as possible for the suction side surface of the vane 1352. If the friction avoiding portion is formed on the preceding sidewall surface 1341*b*1 of the vane slot 1341*b*, a lateral length of the preceding sidewall surface 1341*b*1 of the vane slot 1341*b* becomes shorter. As a result, as the vane 1352 moves backwards at a point when the vane 1352 has not passed the contact point P, the discharge chamber, which is the succeeding compression chamber, may communicate with the suction chamber, which is the preceding compression chamber. This occurrence may cause a refrigerant in the discharge chamber Vd, which is the succeeding compression chamber, to leak into the suction chamber Vs, which is the preceding compression chamber, and this leakage may result in compression loss or suction loss. Therefore, when the friction avoiding portion 1344 is formed on the outer circumferential surface of the roller 1352, the friction avoiding portion 1344 may be formed on the succeeding sidewall surface 1341*b*2 of the both sidewalls of the vane slot 1341*b* to minimize refrigerant leakage.

In addition, when the friction avoiding portion 1344 is formed on the succeeding sidewall 1341*b*2 of the vane slot 1341*b*, a lateral length of the preceding sidewall 1341*b*1 can be maintained. Accordingly, even though the vane 1352 may receive high discharge pressure in a direction from the succeeding sidewall 1341*b*2 to the preceding sidewall 1341*b*1, the preceding sidewall 1341*b*1 of the vane slot 1341*b* can stably support a preceding side of the vane 1352. Furthermore, when the friction avoiding portion 1344 is formed on the outer circumferential surface of the roller 134, friction avoiding portions 1344 may be formed, respectively, in each of the vane slots 1341*a*, 1341*b*, and 1341*c* in a similar manner.

Figure 14:
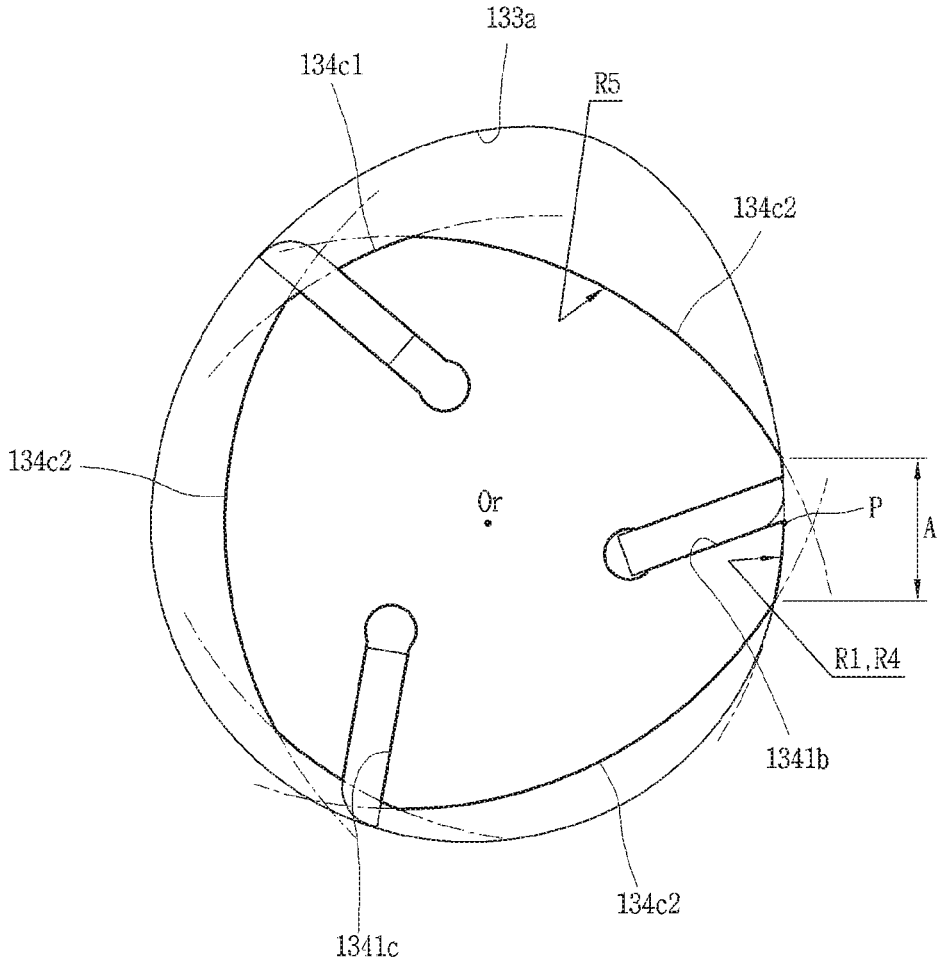
FIG. 14 is a planar view illustrating another embodiment of a roller in a vane rotary compressor according to the present disclosure.

Meanwhile, description will be given of another example of a vane rotary compressor according to the present disclosure. In more detail, in the forgoing embodiments, the surface contact portion 1333 is formed on the inner circumferential surface of the cylinder 133, however, in another example shown in FIG. 14, the surface contact portion 1333 may be formed on the outer circumferential surface of the roller 134.

As shown in the drawings, an outer circumferential surface of the roller 134 according to the present disclosure may be formed in a shape having a plurality of curvatures. For example, the outer circumferential surface 134*c* of the roller 134 may include first portions 134*c*1 having a relatively large curvature and second portions 134*c*2 having a relatively small curvature. The first portions 134*c*1 and the second portions 134*c*2 may be alternately arranged along a circumferential direction.

The first portion 134*c*1 may be a portion formed to have curvature R4 which is equal to or almost equal to the curvature of the inner circumferential surface of the cylinder 133. For example, the curvature R4 may substantially correspond to (e.g., differ by less than 5% from) the curvature R1 of the inner circumferential surface of the cylinder 133 in a section including the contact point P between the second outlet port 1332*b* and the inlet port 1331. For example, the first portion 134*c*1 may be a portion forming the surface contact portion in the vicinity of the contact point. The second portion 134*c*2 may be a portion formed to have curvature R5 relatively smaller than the curvature R1 of the inner circumferential surface of the cylinder 133 in the aforementioned section, which forms a compression space in the vicinity of the contact point P.

The first portions 134*c*1 forming the surface contact portion may include the vane slots 1341*a*, 1341*b*, and 1341*c*, respectively. The vane slots 1341*a*, 1341*b* and 1341*c* may be formed in a substantially similar shape as that of the foregoing embodiments. The arc length of the first portion 134*c*1 may be equal to or longer than the arc length of the vane slots 1341*a*, 1341*b*, and 1341*c*. Hereinafter, description will be given of a first portion close to the contact point P for the sake of convenience, but the principles described herein can be equally applied to the other first portions of the roller 134.

Figure 15:
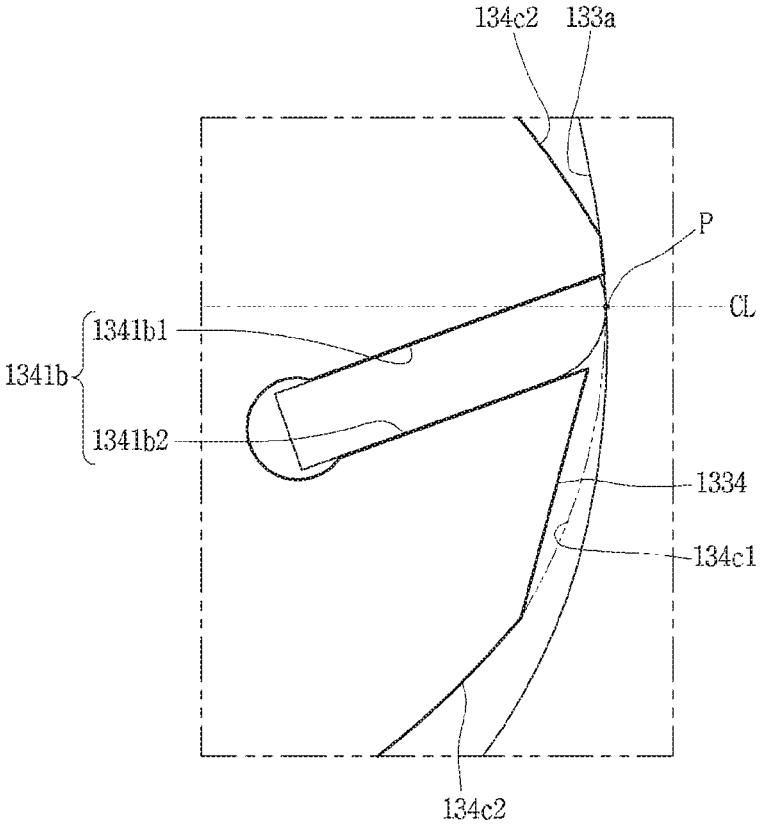
FIG. 15 is a planar view illustrating a cylinder of a vane rotary compressor according to the present disclosure.

As shown in FIG. 15, the vane slot 1341*b* may be eccentrically formed with respect to a radial centerline CL of each first portion 134*c*1. For example, the preceding sidewall 1341*b*1 of the vane slot 1341*b* may be formed to be connected to the preceding end (left end in FIG. 15) of the first portion 134*c*1 with respect to a rotation direction of the roller 134 from the sealing perspective.

In this example, friction may be increased as the first portion 134*c*1 of the roller 134 comes in surface contact with the inner circumferential surface of the cylinder 133. Accordingly, the friction avoiding portion 1334 may be further provided in the inner circumferential surface of the cylinder 133, in particular, between the second outlet port 1332*b* and the inlet port 1331. The friction avoiding portion 1334 may be formed in the same manner as the foregoing embodiments.

In the case where the first portion 134*c*1 defining the surface contact portion is formed on the outer circumferential surface of the roller 134, as described above, the sealing area in the vicinity of the contact point P formed between the cylinder 133 and the roller 134 can be secured, thereby increasing compression efficiency. Furthermore, as a radius of curvature at the first portion 134*c*1 increases, an outer circumferential thickness of the vane slot 1341*b* gets thicker, which can offset lateral force received by the vane 1352. Accordingly, the vane 1352 can be stably supported. In addition, as the vane 1352 is stably supported, the lateral thickness of the vane 1352 can be made thin, thereby reducing friction loss with the cylinder caused by the vane 1352.

One aspect of the present disclosure is to provide a vane rotary compressor that suppresses refrigerant leakage from a section, including a contact point between a cylinder and a roller. Another aspect of the present disclosure is to provide a vane rotary compressor that secures a sealing area between a cylinder and a roller in a section including a contact point. Still another aspect of the present disclosure is to provide a vane rotary compressor having a cylinder and a roller in surface contact by forming an inner circumference surface of a cylinder and an outer circumference surface of a roller to have corresponding curvatures. Still another aspect of the present disclosure is to provide a vane rotary compressor that reduces friction loss while providing a cylinder and a roller in surface contact at a section including a contact point.

Still another aspect of the present disclosure provides a vane rotary compressor in which an inner circumferential surface of a cylinder, in a section including a contact point with roller, is formed to have a double curvature, and a friction avoiding groove is formed on the surface with the double curvature. Still another aspect of the present disclosure provides a vane rotary compressor that minimizes friction loss by optimizing a sealing surface area while forming an inner circumferential surface of a cylinder in a section including a contact point with an internal roller as a sealing surface with a double curvature. Still another aspect of the present disclosure is to provide a vane rotary compressor for suppressing vane vibration through a vane slot and simultaneously minimizing friction loss when high-pressure refrigerants, such as R32, R410a, and CO2, are used.

In order to achieve these and other aspects of the present disclosure, a vane rotary compressor includes a cylinder, a roller having an outer circumferential surface of one side thereof almost coming into contact with an inner circumferential surface of the cylinder to form a contact point, and a plurality of vanes slidably inserted into the roller and dividing a compression space of the cylinder into a plurality of compression chambers, wherein on at least one of the circumferential surface of the roller and the inner circumferential surface of the cylinder is provided a sealing section in which a distance between the outer circumferential surface of the cylinder and the inner circumferential surface of the roller is constantly maintained in a circumferential direction.

In another example, a vane rotary compressor may include a cylinder, a roller having an outer circumferential surface of one side thereof almost coming into contact with an inner circumferential surface of the cylinder to form a contact point, and a plurality of vanes slidably inserted into the roller and dividing a compression space of the cylinder into a plurality of compression chambers, wherein on at least one of the outer circumferential surface of the roller and the inner circumferential surface of the cylinder is provided a section having the same curvature in which curvature of the outer circumferential surface of the roller and curvature of the inner circumferential surface of the cylinder are equally maintained along a circumferential direction. The sealing section or the section with the same curvature may include the contact point in the circumferential direction. In addition, the sealing section or the section with the same curvature may include a recessed friction avoiding groove.

In another example, a vane rotary compressor may include a cylinder that includes a compression space having an inlet port and an outlet port, a roller having an outer circumferential surface of one side thereof almost coming into contact with an inner circumferential surface of the cylinder to form a contact point, a plurality of vanes slidably inserted into the roller and configured to protrude in a direction toward the inner circumferential surface of the cylinder so as to divide the compression space into a plurality of compression chambers, wherein on at least one of the outer circumferential surface of the roller and the inner circumferential surface of the cylinder is provided a surface contact portion between the outer circumferential surface of the cylinder and the inner circumferential surface of the roller is constantly maintained in a preset section including the contact point along the circumferential direction.

The surface contact portion may be formed so that the inner circumferential surface of the cylinder and the outer circumferential surface of the roller have the same curvature.

A shortest lateral distance between the inlet port and the surface contact portion may be shorter than or equal to a lateral thickness of the vane. An arc length of the surface contact portion may be equal to or longer than an arc length formed by connecting both ends of an outer circumferential side of the vane slot from an axial center of the roller.

In addition, a friction avoiding portion may be provided between the inner circumferential surface of the cylinder and the outer circumferential surface of the roller. The friction avoiding portion may be formed as a recessed dimple having a preset depth and width at the surface contact portion. The friction avoiding portion may be formed on the inner circumferential surface of the cylinder, and the friction avoiding portion may be formed so that a circumferential linear length from the contact point to an end of the friction avoiding portion in a rotation direction of the roller is greater than or equal to a lateral thickness of the roller. The friction avoiding portion may be formed to be eccentrically positioned toward the outlet port with respect to the contact point. Also, the friction avoiding portion may be formed to be out of a range of the outlet port.

The friction avoiding portion may be formed on the outer circumferential surface of the roller connected to the vane slot. In addition, the friction avoiding surface may be formed on the outer circumferential surface of the roller connected to a succeeding sidewall with respect to a rotation direction of the roller, of both sidewalls forming the vane slot. For example, the surface contact portion may be formed so that the outer circumferential surface of the roller has the same curvature as that of a preset section including the contact point, of the inner circumferential surfaces of the cylinder. The outer circumferential surface of the roller may be formed to have at least one curvature, and the vane slot may be formed on the surface contact portion.

The vane slot may be eccentrically positioned toward a preceding sidewall with respect to a rotation direction of the roller, of the both sidewall surfaces forming the vane slot. Here, the cylinder may include a plurality of bearings on both axial ends thereof to form a compression space together with the cylinder and radially support a rotation shaft. At least one of the bearings may include a back pressure pocket communicating with a rear side of the vane slot. The back pressure pocket may be divided into a plurality of pockets having different inner pressure along a circumferential direction, and each of the plurality of pockets may include a bearing protrusion portion formed on an inner circumferential side facing an outer circumferential surface of the rotation shaft and forming a radial bearing surface with respect to the outer circumferential surface of the rotation shaft.

In addition, the plurality of pockets may include a first pocket having first pressure and a second pocket having pressure higher than the first pressure. The bearing protrusion portion of the second pocket may include a communication flow path through which an inner circumferential surface of the bearing protrusion portion facing the outer circumferential surface of the rotation shaft communicates with an outer circumferential surface as an opposite side surface of the inner circumferential surface of the bearing protrusion portion.

In a vane rotary compressor, as a surface contact portion is formed on an inner circumferential surface of a cylinder or an outer circumferential surface of a roller in the vicinity of a contact point, a large sealing area of a section including the contact point between the cylinder and the roller can be secured. Accordingly, even when a vane is inserted into a vane slot, refrigerant leakage between compression chambers near the contact point can be suppressed.

Further, as at least one of the inner circumferential surface of the cylinder and the outer circumferential surface of the roller is formed to have double curvature at the section including the contact point, a surface contact portion where the inner circumferential surface of the cylinder and the outer circumferential surface of the roller are in surface contact can be formed. Accordingly, a vane rotary compressor with high efficiency can be provided by easily forming the surface contact portion in the vicinity of the contact point.

Furthermore, the surface contact portion can be provided by forming the inner circumferential surface of the cylinder and the outer circumferential surface of the roller to have the same curvature in the vicinity of the contact point. As a result, a sealing effect in the vicinity of the contact point can be enhanced.

In the vane rotary compressor according to the present disclosure, the surface contact portion is formed at the section including the contact point between the inner circumferential surface of the cylinder and the outer circumferential surface of the roller, and a dimple having a preset width and depth is formed in the surface contact portion. Thus, friction loss can be reduced while widening a sealing area between compression chambers in the vicinity of the contact point.

Further, the inner circumferential surface of the cylinder is formed to have double curvature at a section including the contact point thereof, and a dimple-shaped friction avoiding groove is formed on the surface having the double curvature. Therefore, as described above, the friction loss can be reduced while widening the sealing area between compression chambers in the vicinity of the contact point.

Furthermore, the sealing surface is formed in the section including the contact point while optimizing a range of the sealing surface, which may result in minimizing friction loss between the cylinder and the roller.

In addition, in the vane rotary compressor according to the present disclosure, as the surface contact portion is formed between the cylinder and the roller, leakage between compression chambers caused by vane vibration in the vicinity of the contact point can be suppressed even when using a high-pressure refrigerant, such as R32, R410a, and CO2. Accordingly, suction loss and compression loss can be reduced, resulting in enhancing reliability of the vane rotary compressor using the high-pressure refrigerant. Furthermore, in the vane rotary compressor according to the present disclosure, the aforementioned effects can be achieved even under a low-temperature heating condition, a high-pressure ratio condition, and a high-speed operation condition.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a cylinder including:

an inner circumferential surface defining an internal cavity, an inlet port, and an outlet port; and a roller provided to rotate in the internal cavity of the cylinder and including:

an outer circumferential surface having a region that is positioned within a threshold distance of the inner circumferential surface of the cylinder during the rotation of the roller to define a contact point, a plurality of vane slots that are each formed to have one end opened toward the outer circumferential surface, and a plurality of vanes slidably inserted, respectively, into the vane slots of the roller, the vanes selectively protruding toward the inner circumferential surface of the cylinder so as to divide a compression space between the cylinder and the roller into a plurality of compression chambers, wherein a surface contact region is provided on at least one of the outer circumferential surface of the roller or the inner circumferential surface of the cylinder and is maintained within a preset section that extends in a circumferential direction between the cylinder and the roller and includes the contact point, and wherein a recess is formed on the inner circumferential surface of the cylinder as a recessed dimple, and wherein the recess is formed so that a circumferential linear length from an end of the recess to an end of the surface contact region in a rotation direction of the roller is equal to or greater than a lateral thickness of the vane.

2. The compressor of claim 1, wherein the surface contact region is formed so that the inner circumferential surface of the cylinder and the outer circumferential surface of the roller have corresponding curvatures at the surface contact region.

3. The compressor of claim 2, wherein a shortest lateral distance between the inlet port and the surface contact region is less than or equal to a lateral thickness of the vane.

4. The compressor of claim 2, wherein the surface contact region has an arc length equal to or larger than an arc length formed by connecting opposite ends of an outer circumferential side of the vane slot from an axial center of the roller.

5. The compressor of claim 1, wherein the recess is eccentrically positioned toward the outlet port with respect to the contact point.

6. The compressor of claim 1, wherein the recess is formed on a portion of the outer circumferential surface of the roller connected to one of the vane slots.

7. The compressor of claim 6, wherein the portion of the outer circumferential surface of the roller where the recess is formed is connected to a succeeding sidewall, with respect to a rotation direction of the roller, of a pair of sidewalls defining the one of the vane slots.

8. The compressor of claim 7, wherein the outer circumferential surface of the roller is formed to have at least one curvature, and the one of the vane slots is formed in the surface contact region.

9. The compressor of claim 8, wherein the one of the vane slots is eccentrically positioned toward a preceding sidewall, with respect to a rotation direction of the roller, of the pair of sidewalls defining the vane slot.

10. The compressor of claim 1, wherein the cylinder further includes a plurality of bearings provided at axial ends thereof to form the internal cavity together with the inner circumferential surface of the cylinder and supporting a rotation shaft in a radial direction, wherein at least one of the plurality of bearings corresponds to a back pressure pocket communicating with a rear side of the vane slots, and the back pressure pocket is divided into a plurality of pockets having different inner pressure along the circumferential direction, and wherein each of the plurality of pockets includes a bearing protrusion formed on an inner circumferential side facing an outer circumferential surface of the rotation shaft and forming a radial bearing surface with respect to the outer circumferential surface of the rotation shaft.

11. The compressor of claim 10, wherein the plurality of pockets includes:

a first pocket having first pressure; and a second pocket having a second pressure that is greater than the first pressure, and wherein the bearing protrusion of the second pocket includes a communication flow path through which an inner circumferential surface of the bearing protrusion facing the outer circumferential surface of the rotation shaft communicates with an outer circumferential surface as an opposite side surface of the inner circumferential surface of the bearing protrusion.

12. A compressor, comprising;

a cylinder having an outlet port;

a roller having an outer circumferential surface, one region of the outer circumferential surface being positioned within a threshold distance of an inner circumferential surface of the cylinder to define a contact point; and a plurality of vanes slidably inserted into the roller and dividing a compression space between the cylinder and the roller into a plurality of compression chambers, wherein a sealing region is provided on the inner circumferential surface of the cylinder, a curvature of the outer circumferential surface of the roller corresponding to a curvature of the inner circumferential surface of the cylinder in the sealing region, wherein a recess is formed on the sealing region as a recessed dimple, and wherein the recess is eccentrically positioned toward the outlet port with respect to the contact point, and the recess is formed out of a range of the outlet port.

13. The compressor of claim 12, wherein a distance between the outer circumferential surface of the roller and the inner circumferential surface of the cylinder is constant in a circumferential direction within the sealing region.

14. The compressor of claim 13, wherein the sealing section is formed within a preset section including the contact point in the circumferential direction.

15. The compressor of claim 13, wherein the recess is formed so that a circumferential linear length from an end of the recess to an end of the sealing section in a rotation direction of the roller is equal to or greater than a lateral thickness of the vane.

16. The compressor of claim 12, wherein the curvature of the outer circumferential surface of the roller and the curvature of the inner circumferential surface of the cylinder differ outside of the sealing region in the circumferential direction.

* * * * *